US008826570B2

(12) United States Patent
Torrance

(10) Patent No.: US 8,826,570 B2
(45) **Date of Patent: *Sep. 9, 2014**

(54) BICYCLING SHOE AND BICYCLING SHOE COMPONENTS

(71) Applicant: DashAmerica, Inc., Louisville, CO (US)

(72) Inventor: Tony Torrance, Boulder, CO (US)

(73) Assignee: DashAmerica, Inc., Louisville, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/916,501

(22) Filed: Jun. 12, 2013

(65) Prior Publication Data

US 2013/0269216 A1 Oct. 17, 2013

Related U.S. Application Data

(63) Continuation of application No. 13/703,421, filed as application No. PCT/US2010/038945 on Sep. 9, 2009.

(51) Int. Cl.

| | |
|---|---|
| ***A43B 5/14*** | (2006.01) |
| ***A43C 11/14*** | (2006.01) |
| ***A43B 7/08*** | (2006.01) |

(52) U.S. Cl.

CPC ..... *A43B 5/14* (2013.01); *A43C 11/146* (2013.01); *A43B 7/087* (2013.01); *A43B 7/085* (2013.01); *A43C 11/1493* (2013.01); *A43C 11/1406* (2013.01); *A43C 11/14* (2013.01)

USPC ..... 36/131; 36/50.1; 36/44; 36/144

(58) Field of Classification Search

USPC ..... 36/131, 50.1, 50.5

See application file for complete search history.

(56) References Cited

U.S. PATENT DOCUMENTS

| | | | | | |
|---|---|---|---|---|---|
| 4,079,527 | A | * | 3/1978 | Antonious | 36/51 |
| 4,308,672 | A | * | 1/1982 | Antonious | 36/50.1 |
| 4,616,432 | A | * | 10/1986 | Bunch et al. | 36/50.1 |
| 4,642,914 | A | * | 2/1987 | Caldeira | 36/50.1 |
| 4,679,335 | A | | 7/1987 | Berlese | |
| 4,815,222 | A | * | 3/1989 | Eisenbach et al. | 36/131 |
| 4,825,565 | A | | 5/1989 | Bigolin | |
| 4,845,864 | A | * | 7/1989 | Corliss | 36/131 |
| 4,922,630 | A | | 5/1990 | Robinson | |
| 5,401,564 | A | | 3/1995 | Lee et al. | |
| 5,416,987 | A | | 5/1995 | Bemis et al. | |
| 5,572,774 | A | * | 11/1996 | Duren | 24/306 |
| 5,659,982 | A | | 8/1997 | Muraoka et al. | |
| 5,943,795 | A | * | 8/1999 | Ueda et al. | 36/131 |
| 6,009,641 | A | | 1/2000 | Ryan | |

(Continued)

FOREIGN PATENT DOCUMENTS

| | | | | | |
|---|---|---|---|---|---|
| FR | 2620001 | A1 | * | 3/1989 | A43B 5/00 |
| GB | 2320884 | A | * | 7/1998 | A43C 11/00 |

OTHER PUBLICATIONS

Website entitled, "Cycling—Importance of bike set-up," Sports Coach, 8 pages, accessed May 20, 2009 from (www.brianmac.co.uk/cycling/bikesetup.htm).

(Continued)

*Primary Examiner* — Ted Kavanaugh

(74) *Attorney, Agent, or Firm* — Sheridan Ross P.C.

(57) ABSTRACT

The invention provides bicycling shoes and bicycling shoe components that offer improved comfort, fit, increased efficiency and reduced incidence of injury.

11 Claims, 19 Drawing Sheets

(56) References Cited

U.S. PATENT DOCUMENTS

| | | | | |
|---|---|---|---|---|
| 6,295,743 | B1 * | 10/2001 | Brooks | 36/105 |
| 6,477,793 | B1 | 11/2002 | Pruitt et al. | |
| D475,186 | S * | 6/2003 | Shea et al. | D2/969 |
| D517,298 | S * | 3/2006 | James | D2/969 |
| 7,484,319 | B2 | 2/2009 | Cheskin | |
| 7,533,478 | B2 | 5/2009 | Bird et al. | |
| 2004/0148809 | A1 | 8/2004 | Kikuta | |
| 2008/0276496 | A1 * | 11/2008 | Kerns et al. | 36/131 |
| 2009/0249646 | A1 * | 10/2009 | Sylvestre | 36/89 |
| 2010/0313445 | A1 * | 12/2010 | Hochdoerffer | 36/50.1 |
| 2011/0056095 | A1 * | 3/2011 | Torrance | 36/132 |

OTHER PUBLICATIONS

Website entitled, "Foot & Ankle Anatomy," Northcoast Footcare, updated Apr. 12, 2009, 7 pages, found at (www.northcoastfootcare.com/footcare-info/foot-anatomy.html).

"Shoe," Wikipedia, modified May 11, 2009, 11 pages, found at (www.en.wikipedia.org/wiki/Shoe).

"Specialized BG High Performance Footbeds," Specialized.com, retrieved May 20, 2009, 1 pages, from (www.specialized.com/es/en/bc/SBCEqProduct.jsp?spid+42079&gold_ses=).

"Specialized Body Geometry High Performance Footbed," R & A Cycles, retrieved May 20, 2009, 2 pages, from (www.racyles.com/clothing/accessories/shoe-accessories/specialized-body-geometry-high-performance-footbed.aspx).

"Specialized Shoes: Speed and Comfort!" Seasidecycle.com, retrieved May 20, 2009, 3 pages, from (www.seasidecycle.com/page.cfm?PageID=106).

Empfield "The Cleat Wedge," Bike Fit Systems, LLC, © 2007-2008, 2 pages, found at (www.bikefit.com/articleslowtwitchempfield.php).

Rinaldi "Sports Medicine: Cycling Injuries in Legs and Feet," Vermont Sports, Apr. 1, 2007, 5 pages, retrieved from (www.vtsports.com/articles/sports-medicine-cycling-injuries-legs-and-feet).

Vogel "Foot-Pedal Interface," Biosports Northwest, Aug. 2007, 13 pages.

Thompson "Varus and valgus," University of Oklahoma Health Sciences Center, last updated Sep. 26, 2001, 1 page, retrieved from (www.moon.ouhsc.edu/dthompso/NAMICS/valgus.htm).

International Search Report and Written Opinion for International (PCT) Patent Application No. PCT/US2010/038945, mailed Aug. 3, 2010 8 pages.

International Preliminary Report on Patentability for International (PCT) Patent Application No. PCT/US2010/038945, mailed Jan. 3, 2013 8 pages.

Official Action for New Zealand Patent Application No. 604461, dated Jul. 29, 2013 2 pages.

Official Action for U.S. Appl. No. 13/703,421, mailed Sep. 19, 2013 11 pages.

Notice of Allowance for U.S. Appl. No. 13/703,421, mailed Mar. 4, 2014 8 pages.

Official Action for Canadian Patent Application No. 2,802,338, mailed Nov. 26, 2013, 2 pages.

Official Action for Australian Patent Application No. 2010355333, mailed Sep. 9, 2013, 4 pages.

* cited by examiner

BICYCLING SHOE AND BICYCLING SHOE COMPONENTS

CROSS REFERENCE TO RELATED APPLICATION

This application is a continuation of U.S. patent application Ser. No. 13/703,421, filed Feb. 20, 2013, which is a national stage application under 35 U.S.C. 371 of PCT Application No. PCT/US2010/038945 having an international filing date of Sep. 9, 2009, which designated the United States, and which applications are incorporated by reference in their entirety.

FIELD OF THE INVENTION

The invention relates to bicycling shoes and bicycling shoe elements with improved comfort, fit, and increased efficiency that can reduce the incidence of irritation or injury to the user.

BACKGROUND OF THE INVENTION

Bicycling is a predominately non-weight bearing form of exercise leading to relatively few joint impact injuries. Bicyclists can, however, experience knee and/or foot injuries due to improperly fitted (or adjusted) bicycles or bicycle components (such as, seat, handlebars and pedals), poor riding technique and/or improperly fitting bicycling apparel, such as bicycling shoes. An incorrectly fit bicycle or bicycling shoe and/or a flawed peddling technique can cause anterior knee pain or injury. Furthermore, nerve damage can occur in a weight bearing foot.

During pedaling, the largest force produced by the bicyclist is through the knee and transmitted to the pedal by the foot. A recreational bicyclist reproduces the pedaling force about 4,500 to about 7,500 times an hour. On a long ride or a ride against a headwind or up a hill, incorrect knee alignment while pedaling causes an improper distribution of load on the knee, which results in knee pain or injury. When bicyclists exert more pedal pressure, damage to the nerves in the foot can result, causing burning sensations, pain, and/or numbness in the foot.

Thus, there is a desire for a bicycling shoe that can efficiently function to transfer energy between the riders' foot and the pedal while remaining comfortable and properly adjusted in order to reduce or eliminate irritation and injury to the user.

SUMMARY OF THE INVENTION

The present invention provides a bicycling shoe with unique adjustment and fit componentry that directly addresses bicyclists' need for greater comfort, injury prevention and ease of use.

The shoe of the invention is composed of a sole, an upper, a tongue attached to the upper, a closure system and a cleat attachment element. The upper is attached to the sole to form a toe box, a vamp, a quarter, a throat and an interior cavity.

In one embodiment, the bicycling shoe contains a liner positioned between at least a portion of the upper and tongue and the interior cavity of the shoe. In a preferred embodiment, the liner is positioned between at least most, if not all, of the upper and tongue and the interior cavity.

The liner is a non-irritating material that is substantially non-abrasive to a user's foot positioned within the interior cavity of the shoe. In one aspect of this embodiment, the liner lacks stitching where the user's foot contacts the liner under a shear-force during use. In another aspect of this embodiment, the liner has stitching in a location where a shear-force between the user's foot and the liner is minimal during use. In yet another aspect of this embodiment, the stitching of the liner exposes little, if any, of the stitching to the user's foot positioned in the interior cavity. The liner is preferably composed of a material that is substantially non-irritating to a user's foot positioned in the bicycling shoe.

In one configuration, one or more padding material(s) are positioned between the upper and/or tongue and the liner. The padding material is adhered to the one or both of the liner and the upper and/or tongue by stitching, glue, heat welding or the like. Preferably, the padding material is located at pressure points within the interior cavity of the shoe.

In another aspect of the invention, the sole of the bicycling shoe contains an insole and an outsole, the insole and outsole being in an opposing relationship. In one configuration, the shoe insole is composed primarily or entirely of a material such as a non-irritating liner material, a felt material, a polymeric material, an elastomeric material or combinations of these materials.

In one embodiment, the sole of the shoe contains a lightweight material having substantial rigidity. In a preferred embodiment, this sole contains a plurality of carbon fibers, and more preferably, a plurality of carbon fibers configured in a unidirectional alignment or layup to form a light, stiff material. Even more preferably, the sole contains a unidirectional carbon fiber laminate that may also contain one or more of a polymeric material, a polymeric mixture, a polymeric alloy or combinations of these polymeric materials.

The sole may also contain venting voids in the sole. The sole venting voids extend through the sole to the interior cavity and provide for fluid and air flow into and out of the interior cavity of the bicycling shoe.

In another aspect of the invention, the quarter of the bicycling shoe contains a heel strap. The heel strap is attached to the upper about the heel, the lateral and medial quarter sides and to the sole. The heel strap attaches to the sole at about lateral and medial quarter sides at first and second attachment points. The heel strap is positioned to substantially form an archway over the tuber calcanei of a user's foot positioned in the shoe. In one embodiment, the heel strap contains a material composed of a plurality of carbon fibers, and preferably contains carbon fibers configured in a unidirectional alignment or layup to form a light, stiff material.

The upper of the shoe is composed of one or more durable materials that are sufficiently flexible to provide tightening and/or securing of the upper about the user's foot by a closure system. The upper preferably contains a plurality of vent voids that provide for fluid and air flow into and out of the interior cavity. At least most, if not all, of these upper vent voids are positioned about the tongue, toe box, vamp and quarter of the bicycling shoe. In one embodiment, the upper venting voids are positioned about the tongue, vamp and quarter of the bicycling shoe. In a preferred embodiment, the vent voids transverse the upper and a liner positioned within the internal cavity of the shoe.

One aspect of the invention is a closure system composed of a plurality of straps and a plurality of loops. The straps have a fixed end attached to the lateral side of the upper and the loops are integrally attached to the medial side of the upper. The straps and loops may be attached to the upper by stitching, welding, adhesive bonding or any combination of these attachment means.

In one embodiment of this closure system, the straps contain opposing first and second strap layers. The first strap layer preferably contains the same material as the upper. In another embodiment, the first strap layer differs from the upper material. The second strap layer of this embodiment preferably contains hook and pile materials attached to the first strap layer by stitching, welding, adhesive bonding or a combination of these attachment means.

In preferred embodiments, the second strap layer has a hook material on one end and a pile material on a distal end, configured such that the hook and pile materials interlock when contacted. In one such preferred embodiment, the second strap layer of the fixed end has the hook material and is attached to the upper with the first strap layer contacting the upper. The interlocking of the hook and pile materials on the second layer of the strap is strong enough to secure the shoe to the user's foot while bicycling.

One embodiment of the closure system includes an arch strap, a mid-foot strap, a toe box strap and corresponding loops for each of these straps to interact with to tighten each strap and secure the bicycling shoe to the foot of the user. In these embodiments, the arch, mid-foot and toe box straps intersect a toe-to-heel line at a strap angle. In one embodiment, the strap angle for the arch strap ranges from about 80 degrees to about 100 degrees. In a preferred embodiment, the arch strap angle ranges from about 85 degrees to about 95 degrees. In one embodiment, the strap angle for one or both of the mid-foot and toe box straps ranges from about 80 degrees to about 125 degrees. In a preferred embodiment, the strap angle for the mid-foot and/or toe box straps ranges from about 95 degrees to about 120 degrees, and in an even more preferred embodiment, the strap angle for the mid-foot and/or toe box straps ranges from about 100 degrees to about 115 degrees. In one configuration, the closure system is composed of one arch strap and one toe box strap and thus, the closure system of this embodiment lacks a mid-foot strap.

In preferred embodiments of the invention, the arch strap and the mid-foot strap are separated by a distance that is sufficiently large enough to substantially relieve pressure generated by the closure system on the medial branch of the deep fibular nerve, flexor digitorum longus tendon and/or flexor digitorium bevis muscle of a user's foot positioned in the bicycle shoe with the shoe secured to the user's foot. The arch and mid-foot straps have nearest neighbor edges. The distance separating the arch and mid-foot straps is average of the respective nearest neighbor edges. In one preferred configuration, the distance between these straps is greater than about 0.3 inch. In a preferred embodiment, the distance from between these straps is from about 0.7 to about 1.1 inch.

In another aspect of the invention, the shoe further comprises an offset throat and tongue such that the throat and tongue angle away from the medial side of the shoe and away from the heel to toe center line of the shoe towards the lateral side of the upper. This configuration, when secured by a closure system about a user's foot, reduces pressure to the nerves and tendons in the upper portion of the user's foot thereby reducing injuries and discomfort to a user's foot when wearing the bicycling shoe, particularly for prolonged periods of time.

In another aspect of the invention, the shoe further comprises a linear rack having a plurality of teeth, a release clip, and the arch strap having a strap support, a pawl and a strap rack. The linear rack and release clip are, respectively attached to the upper medial and lateral sides. The release clip comprises a ratchet mechanism that adaptively engages the strap rack and a release leveler that disengages the strap rack from the ratchet mechanism. The release leveler simply and easily disengages the strap by one of pushing and/or lifting of the release leveler.

The linear rack and plurality of teeth are configured and attached to the shoe to adaptively engage the pawl. In one configuration, the pawl comprises two cylindrical arms extending from an arch strap.

The strap support extends out from the arch strap, as well as, along a portion of the arch strap. In one configuration, the strap support comprises a one or more distinct elements. The distinct elements can differ in composition and shape.

The pawl adaptively engages and disengages from the linear rack. The pawl adaptively engages the linear rack at one of a plurality of engagement locations on the linear rack.

The shoe further comprises one or more gaiting assist. The gaiting assist may be located at one of an anterior or a posterior portion of the sole, or both of these positions. In one configuration, the gaiting assist is attached to the sole. In another configuration, the gaiting assist is at least partially embedded in the sole.

A cleat attachment element comprises any element suitable for attaching a bicycle clipless cleat. The cleat attachment element is situated on the sole corresponding to a position below the metatarsal region of the user's foot when positioned in the shoe.

Yet another aspect of the present invention is an insole insert. The insole insert contains opposing lateral and medial sides, opposing toe and heel ends, a mid-section positioned between the toe and heel ends and opposing inner and outer surfaces. The insole insert also contains a varus wedge element and an aft-support element. The toe and heel ends have toe and heel edges, respectively. Similarly, the lateral and medial sides have lateral and medial edges, respectively.

In one embodiment, the insole has a bi-layer construction having first and second layers. The first layer has opposing first layer top and bottom surfaces and extends from the toe edge to the heel edge and from the medial edge to the lateral edge. The layers of this insert may also contain one or more voids.

The second layer of the insert has a varus wedge element and an aft-support element. The varus wedge element is positioned adjacent to the aft-support element. The varus wedge element and the aft-support element interconnect and mate with first and second voids to form a substantially smooth outer surface.

The varus wedge element has opposing medial and lateral edges and opposing toe and metatarsal edges. The varus medial and lateral edges respectively have varus medial and lateral thicknesses. Preferably, the medial and lateral thicknesses of the varus wedge element differ. In one embodiment, the varus medial edge thickness is greater than the thickness of the varus lateral edge. Preferably, the medial and lateral thicknesses of the varus wedge element differ from about 1.0 mm to about 5 mm, more preferably from about 1.2 mm to about 1.7 mm.

The varus wedge also has a medial-lateral cross-sectional thickness. In one embodiment, the cross-sectional thickness of the varus wedge uniformly transitions from the medial thickness to the lateral thickness. In one embodiment, the medial thickness ranges from about 0.5 mm to about 10.0 mm. In a preferred embodiment, the medial thickness ranges from about 1.0 mm to about 8.0 mm, even more preferably, the medial thickness ranges from about 4.0 mm to about 8.0 mm. The lateral thickness ranges from about 0.1 mm to about 5.0 mm, preferably from about 0.5 mm to about 5 mm. More preferably, the lateral thickness ranges from about 1 mm to about 3 mm.

The toe and metatarsal edges of the varus wedge have toe and metatarsal thicknesses. Preferably, the toe and metatarsal thicknesses differ. In one embodiment, the toe thickness is greater than the metatarsal thickness. In a preferred embodiment, the toe and metatarsal thicknesses differ from about 0.5 mm to about 8 mm. In a more preferred embodiment, the toe and metatarsal thicknesses differ from about 1 mm to about 4 mm.

The varus wedge also has a toe-metatarsal cross-sectional thickness. In a preferred embodiment, the toe-metatarsal cross-sectional thickness uniformly transitions from the metatarsal thickness to the toe thickness.

The varus wedge toe thickness ranges from about 0.1 mm to about 5.0 mm. In a preferred embodiment, the toe thickness ranges from about 0.5 mm to about 5.0 mm, even more preferably, the toe thickness ranges from about 1.0 to about 3.0 mm. The metatarsal thickness of the varus wedge ranges from about 0.5 mm to about 10.0 mm, and preferably from about 1.0 mm to about 8.0 mm. More preferably, the metatarsal thickness ranges from about 4.0 mm to about 8.0 mm.

The varus wedge element is positioned in the bicycling shoe such that when the user's foot is in the shoe and the user applies pressure to the bicycle pedal, the varus wedge resides between the user's forefoot and the bicycle pedal. The location of the varus wedge element between the user's foot and the bicycle pedal aligns one or both of the user's forefoot and knee when applying force to the pedal.

In one embodiment, the varus wedge element is positioned within a void such that the varus wedge is aligned under the toe and metatarsal regions of a user's foot, when the user's foot is secured in the bicycle shoe.

In one embodiment, the varus wedge element contains one or more transverse varus channels and each transverse varus channel has one or more varus channel eyelets. A varus wedge element having one or more varus channels has a greater flexibility than a varus wedge element lacking a channel or plurality of channels. The varus channel eyelet(s) further enhance the flexibility of the varus wedge.

In one embodiment, the insole insert has a plurality of varus comfort voids. The varus comfort void comprises a void volume defined by opposing first and second channel walls, the first layer bottom surface and a sole surface. Preferably, the varus comfort void interconnects with a vent void in the insole insert. The vent void extends through the first layer and an optional textile adhered to the top surface. The extension of the first layer into the one or more comfort voids provides cushioning and/or flexion to the insole insert. The cushioning and flexion of the insole insert provides a more even distribution of pressure at or near a pressure point on the user's foot.

The vent voids transmit fluid or air to provide further comfort to the user's foot. The cushioning and flexion of the insole insert further facilitates fluid or air transmission through the vent voids. The fluid transmission through the vent voids removes at least some, if not most, of the fluids away from the user's foot, thereby providing even more comfort to the user.

The insole insert may also include an arch, transverse and lateral supports and/or a heel cup. An arch support provides support to medial arch of the user's foot, while the lateral support provides support to lateral arch and lateral plantar aponeuriois and calcaneometarasal ligament. The transverse support provides support of planatar apotenuriois, digital slip of the plantar aponeurosist, and transvere faciculi. The support provided by the arch and the lateral and transverse supports substantially reduces hot spots, pain and numbness in the user's foot caused by the repeated application of pressure on the foot and pedal when pedaling. The heel cup provides additional support and stability to the foot.

The heel cup and arch, transverse and lateral supports are strengthened and stabilized by a plurality of insole grooves. The insole grooves are positioned to provide at least some additional strength and/or stability to the supports and heel cup beyond the strength and stability of first and/or second layers. The insole grooves provide a degree of flexibility to the insole insert. The grooves have a groove depth from about 0.25 mm to about 2.5 mm, preferably about 0.7 mm to about 1.2 mm.

The first layer of the insole, the aft-support element and the varus wedge element preferably contain a polymeric material, and the polymeric material composing each of the first layer, the aft-support element and the varus wedge element can be the same or can differ.

In one embodiment, the varus wedge element contains polyurethane. The polyurethane has a hardness value from about 115 to about 65 on the shore A scale. In a preferred embodiment, the hardness value for the polyurethane ranges from about 105 to about 70 on the shore A scale, more preferred from about 100 to about 75 on the shore A scale. Even more preferably, the hardness ranges from about 90 to about 80 on the shore A scale.

In another embodiment, the first layer of the insole and the arch-support element comprises ethylene-vinyl acetate and/or polyurethane. The ethylene-vinyl acetate has a hardness value from about 60 to about 30 on the shore durometer scale. In a preferred embodiment, the hardness value of the ethylene-vinyl acetate is from about 55 to about 40 on the Asker C scale, even more preferred from about 52 to about 44 on the Asker C scale.

In one configuration of the invention, the insole insert is positioned between optional first and second textile layers. The first and second textile layers are composed of natural and/or synthetic textiles materials, such as plant fibers, animal fibers, rayons, polyesters, nylons, acrylics, aramids, polyamides, polyurethanes, polyolefins and mixtures thereof. The first and second textile layers may be composed of the same textile materials or differ.

As used herein, the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The terms "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The preceding is a simplified summary of the invention to provide an understanding of some aspects of the invention. This summary is neither an extensive nor exhaustive overview of the invention and its various embodiments. As will be appreciated, other embodiments of the invention are possible utilizing, alone or in combination, one or more of the features set forth above or described in detail below.

DESCRIPTION OF THE EMBODIMENTS

Figure 1:
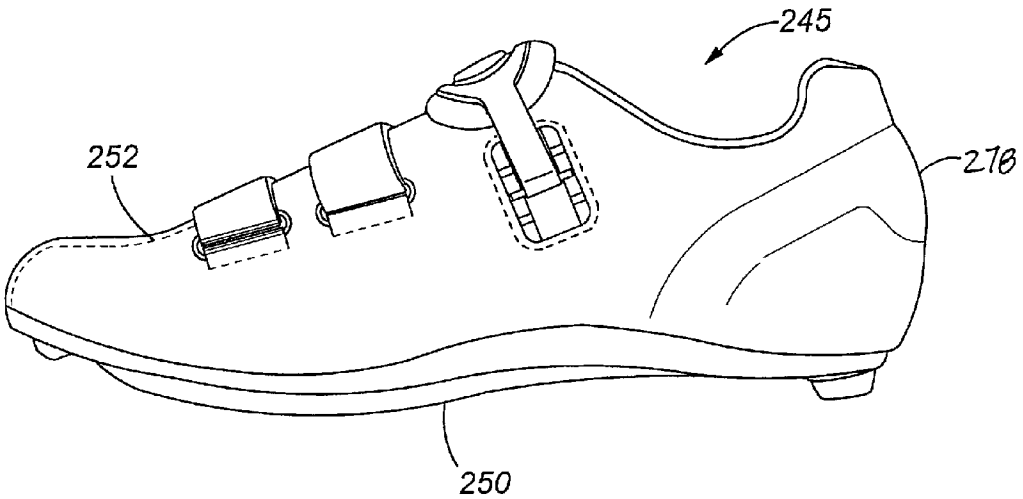
FIG. 1 depicts an elevation view of one embodiment of the present invention.

FIGS. 1-24 depict aspects of a bicycling shoe of the present invention, as well as individual components of the bicycling shoes of the invention. The bicycling shoe 245 including a sole 250, an upper 252, a tongue 251 attached to the upper 252, a closure system 246. The upper 252 is attached to the sole 250 to form a toe box 253, a vamp 259, a quarter 260, a throat 257 and an interior cavity 261. The upper 252 is attached to the sole 250 and/or the tongue 251 by any method well known in the art such as stitching, welding and adhesive bonding.

As used herein the term bicycling shoe may include either left or right forms of the bicycling shoe. Furthermore, the bicycling shoe includes a bicycling shoe designed to fit a man, a woman, or both. The bicycling shoe has a shoe size according to any international shoe size designation standard. For example, without limitation, the bicycling shoe may have a size designation selected from the group consisting of the United States standard shoe size designations of: 5, 5½, 6, 6½, 7, 7½, 8, 8½, 9, 9½, 10, 10½, 11, 11½, 12, 12½, 13, 13½, 14, 14½, 15, 15½, 16, 16½, 17, 17½, 18, 18½, 19, 19½, and 20 and a width selected from the group of widths consisting of the United States standard widths of: AAA, AA, A, B, C, D, E, EE, EEE, EEEE, F and G.

Figure 2:
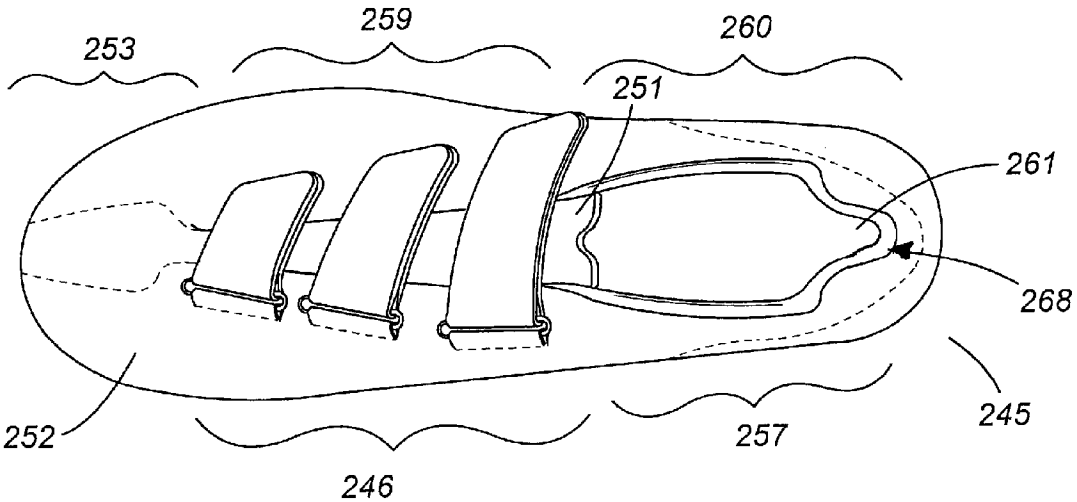
FIG. 2 depicts a top elevation view of another embodiment of the present invention.
Figure 3:
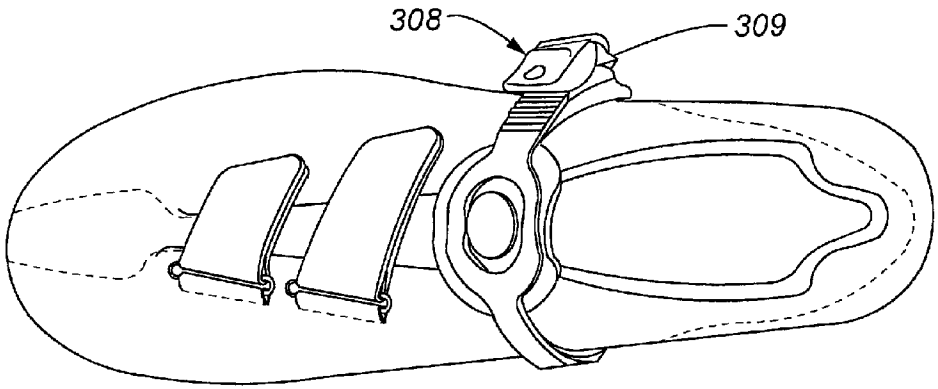
FIG. 3 depicts another top view of another embodiment of the present invention.
Figure 4:
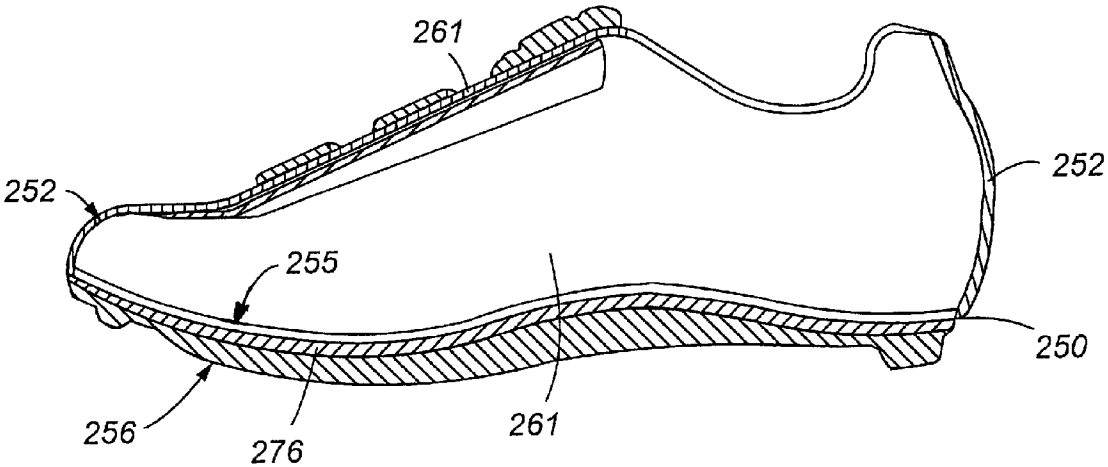
FIG. 4 depicts cross-sectional elevation view of yet another embodiment of the present invention.
Figure 7A:
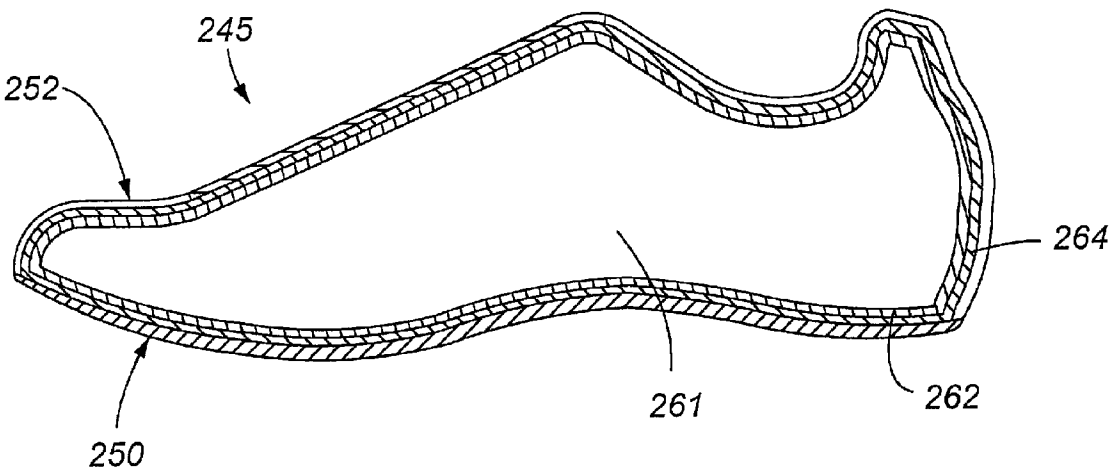
FIG. 7A depicts a side cross-sectional view of another embodiment of the present invention.

In the embodiments depicted in FIGS. 2 and 7A, the bicycling shoe 245 includes a liner 262 positioned between at least a portion of the upper 252 (and/or tongue 251) and the interior cavity 261, preferably the liner 262 is positioned between at least most of, if not all of, the upper 252 (and/or tongue 251) and the interior cavity 261. The liner 262 may be attached to the upper 252 (and/or tongue 251) by at least one of stitching, welding and adhesive bonding. Preferably, the liner 262 comprises a non-irritating material. A non-irritating material means a material that is substantially non-abrasive to a user's foot positioned within the interior cavity 261 of the shoe. Non-limiting examples of substantially non-abrasive liner configurations include: 1) the liner substantially lacks stitching where the user's foot contacts the liner 262 under a shear-force during use; 2) the liner 262 has stitching in a location where a shear-force between the user's foot and the liner 262 is minimal during use; 3) the stitching exposes little, if any, of the stitching to the user's foot; and 4) the stitching comprises a non-irritating material.

In the embodiments depicted in FIGS. 2 and 6A-7A, a padding material 264 is positioned between the upper 252 (and/or tongue 251) and the liner 262. In one configuration, the padding material 264 is adhered to one or both of the liner 262 and the upper 252 (and/or tongue 251). The padding material 264 is adhered to the upper 252 (and/or tongue 251) by one or more of stitching, welding and adhesive bonding. Preferably, the padding material 264 is located at pressure points, i.e., points within the interior cavity 261 where pressure is applied to a user's foot when secured in the bicycling shoe. Non-limiting examples of pressure points within the interior cavity 261 include, without limitation, heel compartment 266, throat border 268 of the quarter section 260 and tongue underside 270. The padding 264 may also be located to assist in properly aligning the user's foot within the interior cavity 261. For example, padding may assist in properly aligning the user's foot on opposing lateral 272 and medial 274 quarter sides.

The sole 250 includes an insole 255 and an outsole 256, the insole 255 and outsole 256 being in an opposing relationship. In one embodiment, a midsole 276 is situated between the insole 255 and the outsole 256. In one configuration, the insole 255 comprises a non-irritating liner material, a felt material, a polymeric material, an elastomeric material, and/or an insole insert (as described further below).

In another embodiment, the sole 250 includes a lightweight material that has a substantial rigidity. Substantial rigidity means the sole 250 bends little, if any, when the cyclist applies a pedaling pressure to the sole 250. In a preferred embodiment, the sole includes a plurality of carbon fibers, more preferably unidirectionally-aligned carbon fibers. Carbon fibers are preferred for their strength and lightweight. In an even more preferred embodiment, the sole 250 contains a unidirectional carbon fiber laminate, including at least one of a polymeric material, a polymeric mixture, a polymeric alloy, and a combination thereof.

The embodiments depicted in FIGS. 1 and 2 include a heel strap 278 in the quarter 260 of the bicycling shoe 245. The heel strap 278 is attached to the upper about the heel, the lateral and medial quarter sides and to the sole 250. As shown in the embodiment depicted in FIG. 14, the heel strap 278 attaches to the sole at lateral and medial quarter sides at first 279 and second 281 attachment points. The heel strap 278 is positioned to wrap about a user's heel when the user's foot is positioned within the bicycling shoe 245. More specifically, the heel strap 278 is positioned to substantially form an archway over a user's heel tuber calcanei. That is, the heel strap 278 is positioned about the superior, lateral and medial portions of the tuber calcanei and calcaneus portions of a user's foot when the user's foot is positioned within the bicycling shoe 245. The first 279 and second 281 attachment points, respectively, align with anterior and posterior planes of a user's tibia when the user's foot is positioned within the bicycling shoe 245. In one embodiment, the heel strap 278 comprises a material containing a plurality of carbon fibers, preferably containing a plurality of unidirectional carbon fibers.

The upper 252 comprises a durable material. Preferably, the durable material comprises one or more of a material selected from the group consisting of a natural or synthetic leather, a polymeric material, a polymeric mixture, a polymeric alloy, a laminate, a natural or synthetic textile material, a mesh material, or a combination thereof. Preferably, the material comprises a flexible material. That is, the material has substantial flexibility to provide tightening and/or securing of the upper 252 about the user's foot by the closure system 246. In one configuration, the upper 252 (including the tongue 251) is composed of two or more durable materials. For example, the toe box 253 may be composed of one material (such as a mesh material) while the reminder of the upper 252 is composed of another material.

Figure 5B:
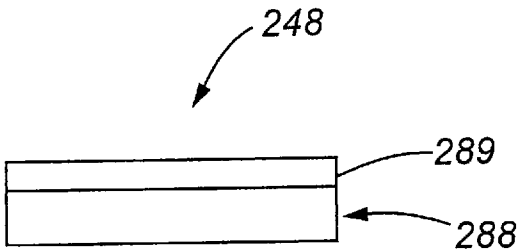
FIG. 5B depicts a cross-sectional view of a closure strap of the embodiment of FIG. 5A.
Figure 5A:
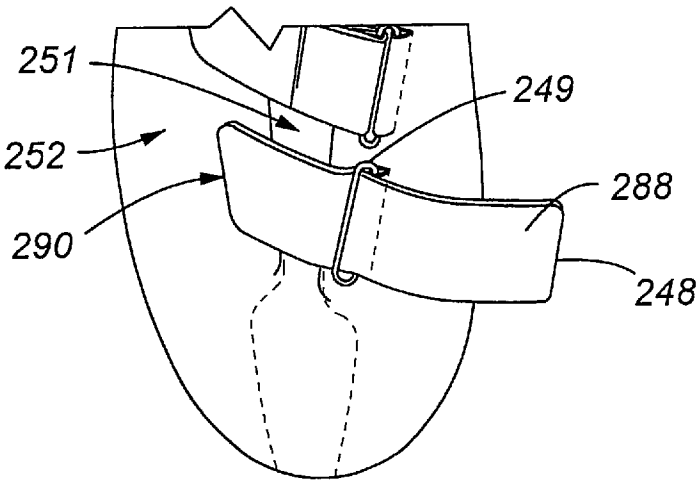
FIG. 5A depicts a top view of a portion of an embodiment of the present invention.
Figure 6A:
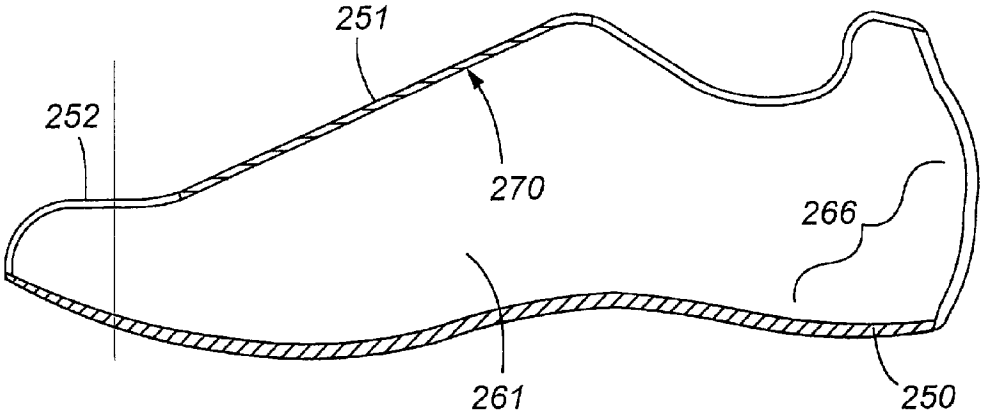
FIG. 6A depicts a side cross-sectional view of another embodiment of the present invention.
Figure 6B:
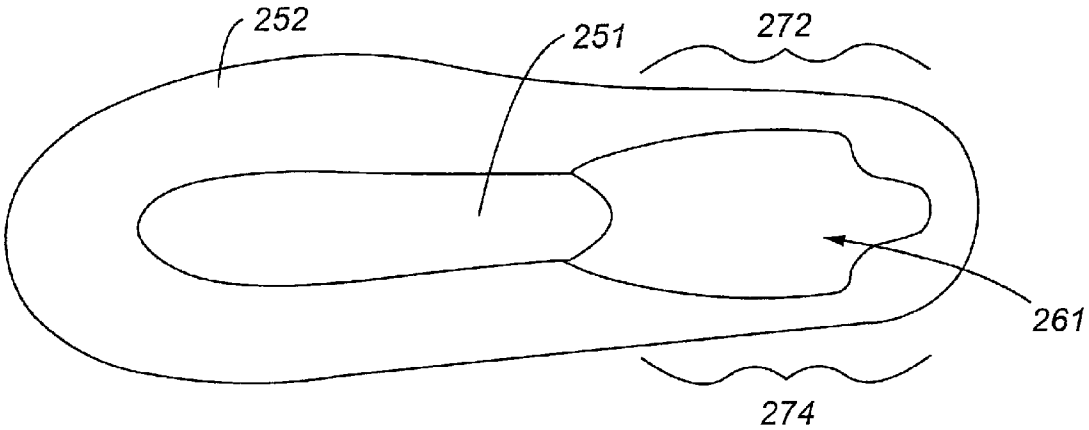
FIG. 6B depicts a top view of the embodiment of FIG. 6A.
Figure 8:
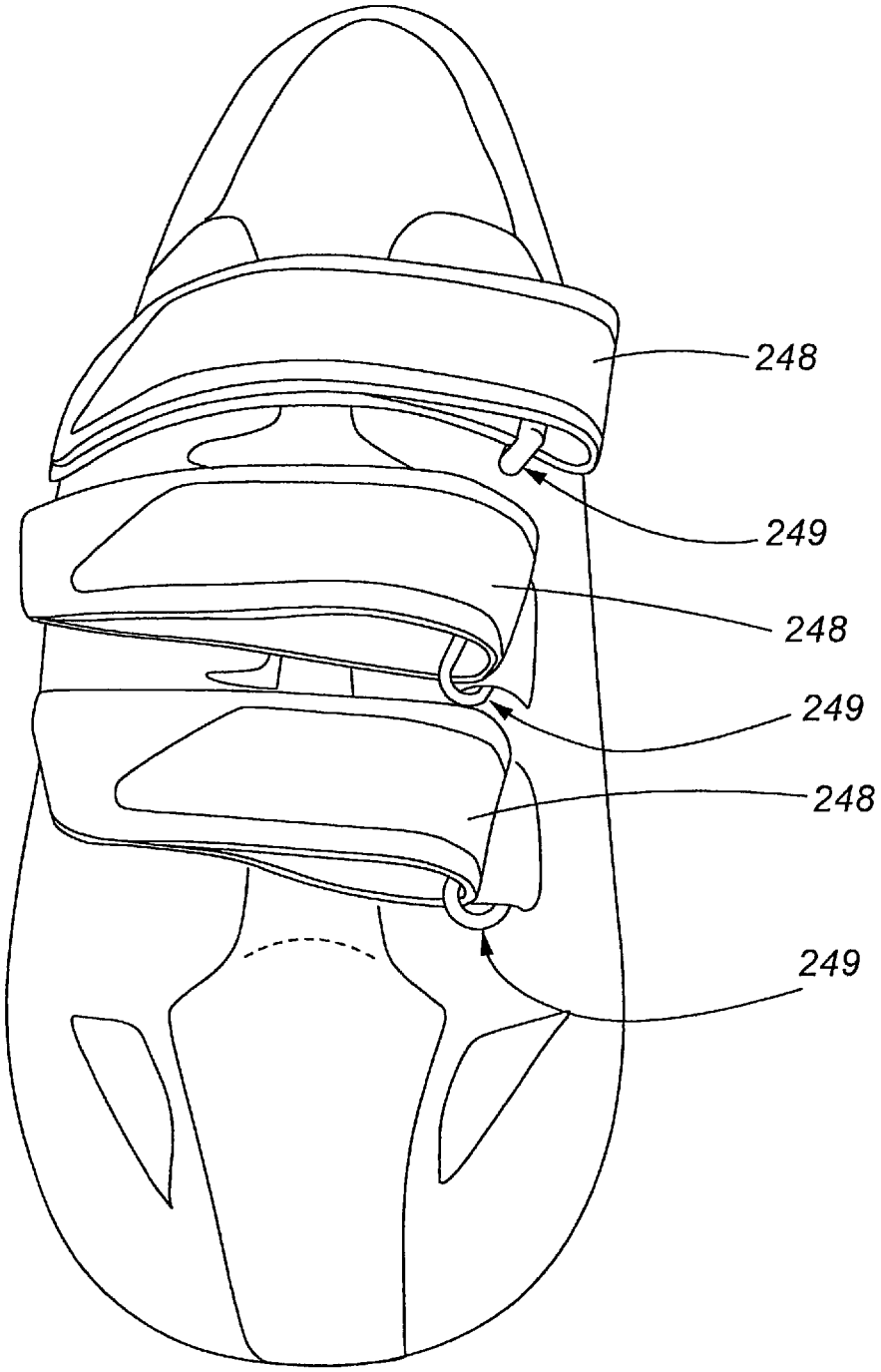
FIG. 8 depicts a front elevation view of another embodiment of the present invention.
Figure 9:
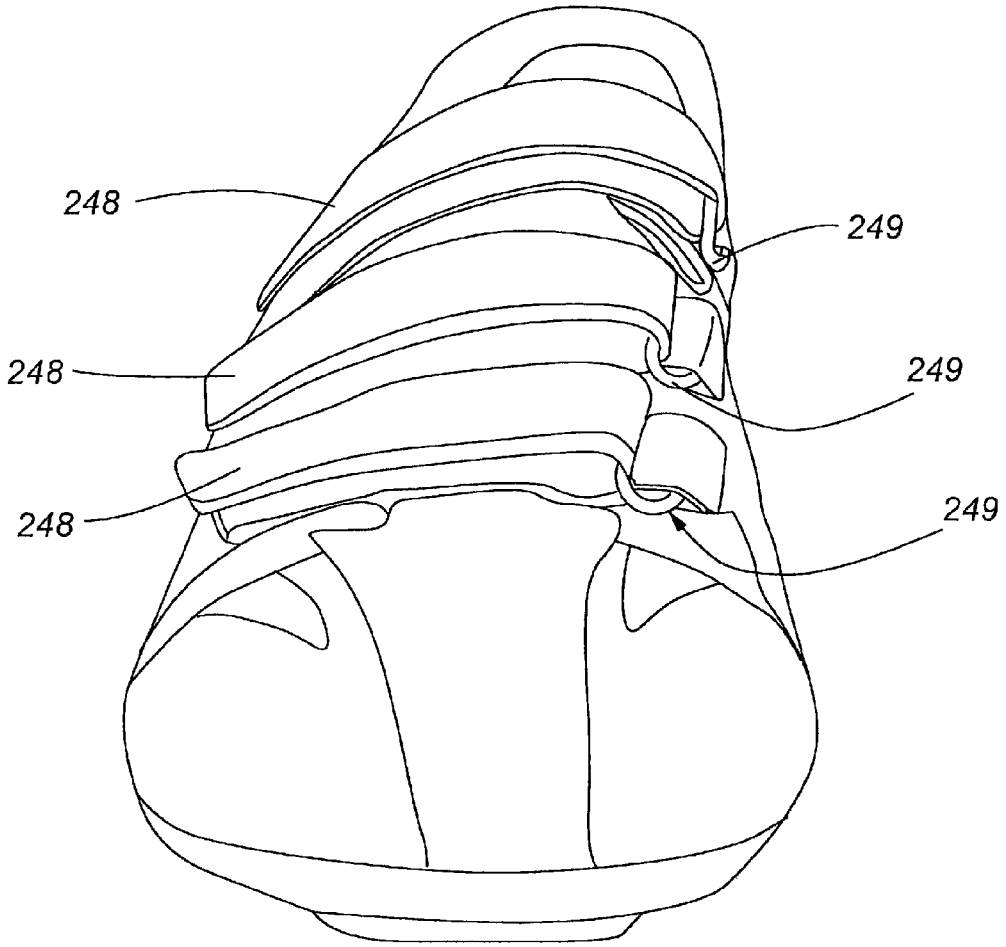
FIG. 9 depicts another front elevation view of an embodiment of the present invention.

One aspect of the invention is a closure system that is depicted in the embodiments shown in FIGS. 5A, 8 and 9. The closure system contains a plurality of straps 248 and a plurality of loops 249. The straps 248 have a fixed end 290 attached to the lateral side of the upper 252 and the loops 249 are integrally attached to the medial side of the upper 252. The straps 248 and loops 249 are attached to the upper 252 by at least one of stitching, welding, adhesive bonding or a combination thereof.

As depicted in FIG. 5B the straps 248 preferably include opposing first 288 and second 289 strap layers. The first strap layer 288 contains an upper material (as disclosed above), preferably the same material as the upper 252. However, for design purposes, the first strap layer 288 may include an upper material differing from the material of the upper 252. The hook and pile materials of the second strap layer 289 are attached to the first strap layer 288 by at least one of stitching, welding, adhesive bonding or a combination thereof.

The second strap layer 289 has a hook material on one end and a pile material on a distal end, the hook and pile materials interlock when contacted. In a preferred embodiment, the second strap layer 289 of the fixed end 290 has the hook material and is attached to the upper 252 with the first strap layer 288 contacting the upper 252.

To secure the shoe 245 to the user's foot, the straps 248 are drawn across the top of the upper 252 through corresponding loops 249, back over the upper 252, and the hook material is contacted with the pile material. The interlocking of the hook and pile materials on the second layer 289 of the strap 248 is at least strong enough to secure the shoe 245 to the user's foot.

Figure 10:
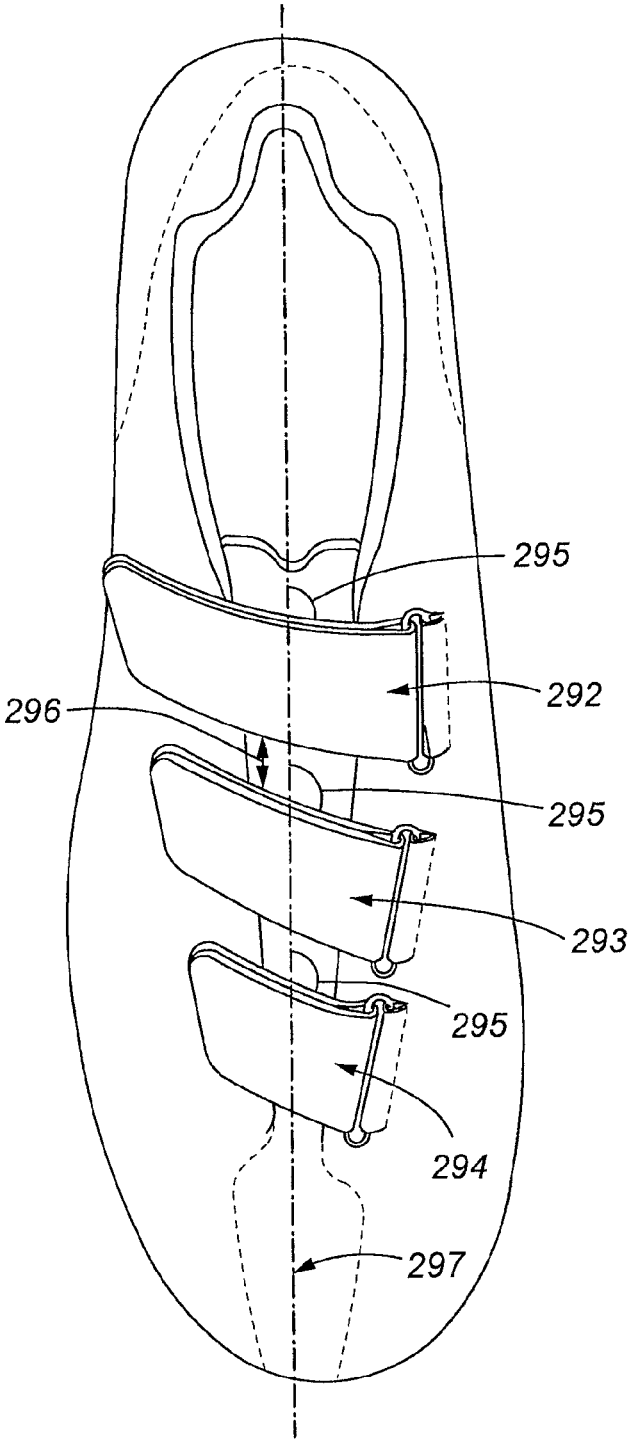
FIG. 10 depicts a top elevation view of an embodiment of the present invention.
Figure 11:
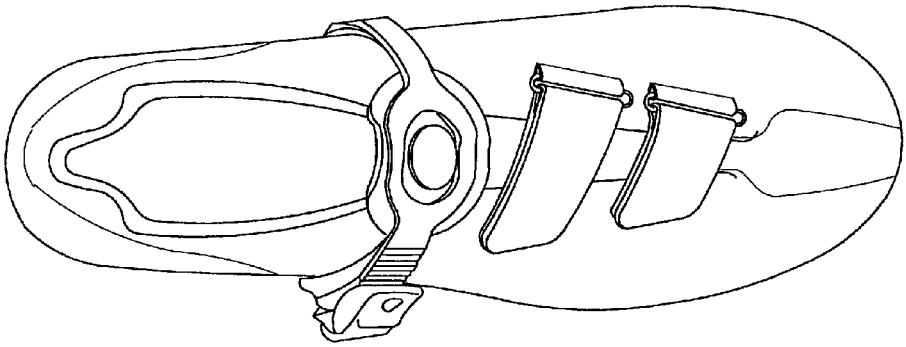
FIG. 11 depicts another top elevation view of an embodiment of the present invention.
Figure 12:
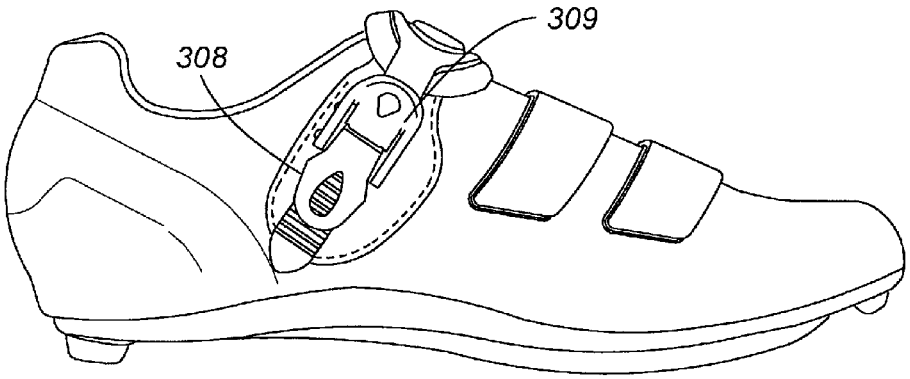
FIG. 12 depicts a left side elevation view of the embodiment of FIG. 11.
Figure 13:
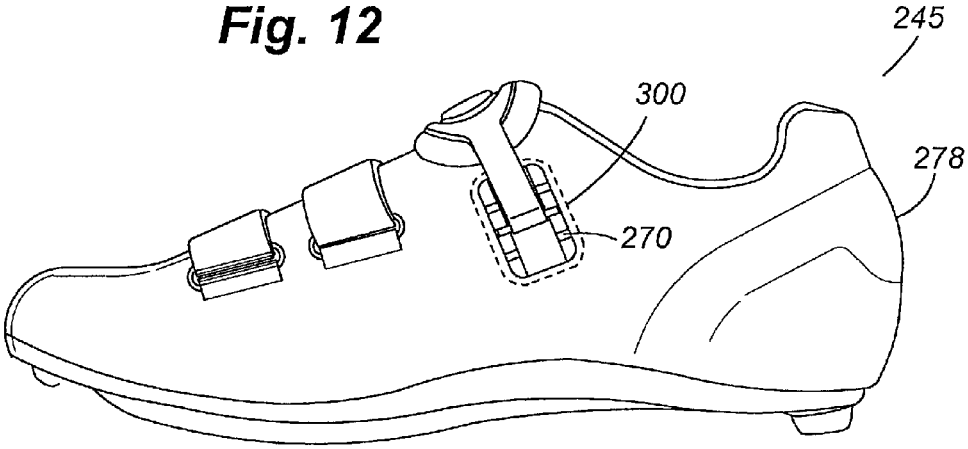
FIG. 13 depicts a right side elevation view of the embodiment of FIG. 11.

In a preferred embodiment depicted in FIG. 10, the closure system comprises an arch strap 292, a mid-foot strap 293, a toe box strap 294 and corresponding loops. The arch strap 292, mid-foot strap 293 and toe box strap 294 intersect a toe-to-heel line 297 at a strap angle 295. The strap angle 295 for the arch strap 292 ranges from about 80 degrees to about 100 degrees, more preferably ranges from about 85 degrees to about 95 degrees. In another preferred embodiment, the strap angle 295 for at least one of the mid-foot strap 293 and toe box strap 294 ranges from about 80 degrees to about 125 degrees. More preferably, the strap angle 295 for at least one of the mid-foot strap 293 and toe box strap 294 ranges from about 95 degrees to about 120 degrees, and even more preferably from about 100 degrees to about 115 degrees. This strap angle 295 in excess of 90 degrees creates a closure system that closes the throat of the bicycling shoe over the tongue, to secure a user's foot in the bicycling shoe while minimizing pressure applied by the tongue and the closure system on the medial branch of the deep fibular nerve, flexor digitorum longus tendon and/or flexor digitorium bevis muscle of a user's foot. This increases comfort and reduces potential injury to the nerves in the foot of a user, particularly when the bicycling shoe is secured on the user's foot for a prolonged period of time. In one embodiment, the closure system includes only an arch strap 292 and a toe box strap 294.

In the preferred embodiment of FIG. 10, the distance 296 between the arch strap 292 and mid-foot strap 293 is sufficiently large to distribute pressure generated by the closure system on the medial branch of the deep fibular nerve, flexor digitorum longus tendon and/or flexor digitorium bevis muscle of a user's foot. In one preferred configuration, the distance 296 is greater than about 0.3 inch, more preferably the distance 296 is greater than about 0.5 inch. In an even more preferred configuration, the distance is from about 0.7 to about 1.1 inch. The greater the distance between the arch strap 292 and mid-foot strap 293, the more the pressure on the user's foot is relieved. More specifically, the greater distance between the arch strap 292 and mid-foot strap 293, the less pressure being applied by the straps to the user's medial branch of deep fibular nerve, flexor digitorum longus tendon and/or flexor digitorium bevis muscle.

Figure 21:
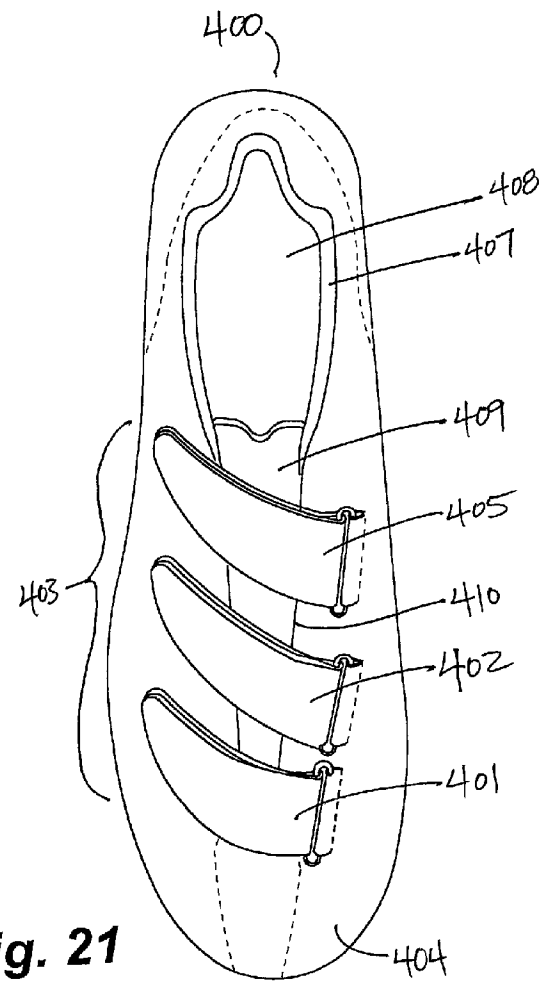
FIG. 21 depicts a preferred embodiment of the bicycling shoe of the invention.

Another aspect of the invention related to the comfort of the user and reduced potential for injury is an offset throat in a bicycling shoe. FIG. 21 shows an embodiment of the bicycling shoe 400 of the invention, including a closure system 403 composed of three straps: an arch strap 405, a mid-foot strap 402, and a toe box strap 401. The closure system 403 closes the throat 410 over the tongue 409, to secure a user's foot in the bicycling shoe 400. The closure 403 also secures the throat boarder 407 around an ankle of a user when the user's foot is secured in the interior cavity 408 of the shoe. As depicted in FIG. 21, the throat 410, the tongue 409 and the closure system 403 are located symmetrically on the center line of the upper 404 of the bicycling shoe 400. As noted above, the arch strap 405, mid-foot strap 402, and/or toe box straps 401 having a strap angle in excess of 90 degrees creates a closure system that closes the throat of the bicycling shoe over the tongue, to secure a user's foot in the bicycling shoe while minimizing pressure applied by the tongue and the closure system to the medial branch of the deep fibular nerve, flexor digitorum longus tendon and/or flexor digitorium bevis muscle of a user's foot.

Figure 22:
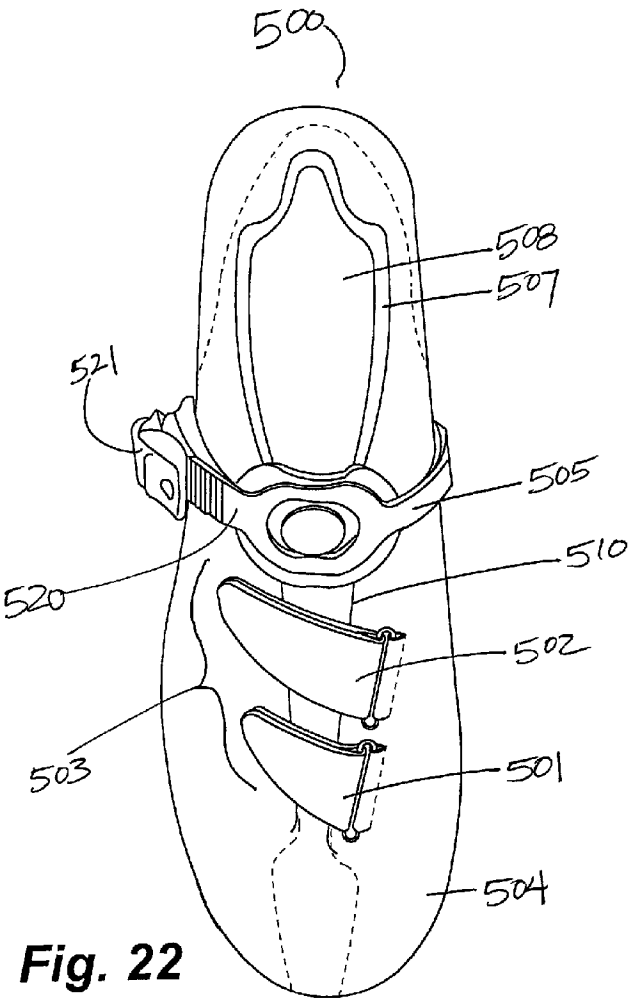
FIG. 22 depicts another preferred embodiment of the bicycling shoe of the invention.

Similar to the embodiment depicted in FIG. 21, FIG. 22 shows an embodiment of the bicycling shoe 500 of the invention, including a closure system 503 composed of an arch buckle 505 and two straps: a mid-foot strap 502, and a toe box strap 501. The arch buckle 505 includes an arch strap 520, coupled with a release clip 521. The closure system 503 closes the throat 510 over the tongue 509, to secure a user's foot in the bicycling shoe 500. The closure 503 also secures the throat boarder 507 around an ankle of a user when the user's foot is secured in the interior cavity 508 of the shoe. As depicted in FIG. 22, the throat 510, the tongue 509 and the closure system 503 are located symmetrically on the center line of the upper 504 of the bicycling shoe 500. In this embodiment, the mid-foot strap 502, and/or toe box strap 501 have a strap angle in excess of 90 degrees, creating a closure system that closes the throat of the bicycling shoe over the tongue to secure a user's foot in the bicycling shoe while minimizing pressure applied by the tongue and the closure system to the medial branch of the deep fibular nerve, flexor digitorum longus tendon and/or flexor digitorium bevis muscle of a user's foot.

Figure 24:
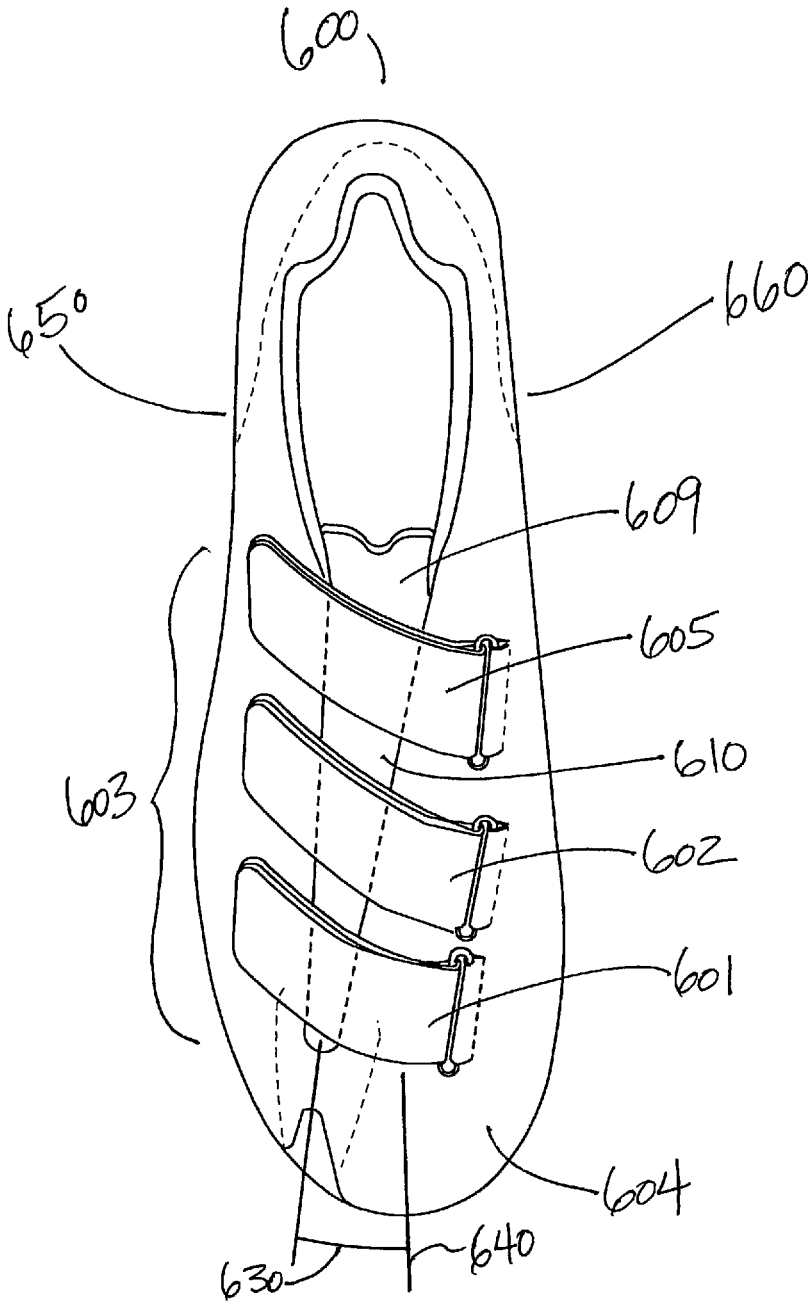

Comparing the embodiments of FIGS. 24 and 25, the skilled artisan will readily appreciate that another embodiment of the invention is a bicycling shoe 600 having an offset throat 610. That is, the throat 610 is not located symmetrically on the center line of the upper 604 of the bicycling shoe 600. Instead, the throat 610 and tongue 609 are located asymmetrically, angling toward the lateral 650 side of the upper 604 and away from the medial 660 side of the upper 604 of the bicycling shoe. The throat angles away from the toe-to-heel center line at an offset throat angle 630, which ranges from about 5 degrees to about 30 degrees, more preferably ranges from about 10 degrees to about 15 degrees. More preferably, the offset throat angle 630 is about 12 degrees. This offset throat angle 630 minimizes pressure applied by the tongue and the closure system on the medial branch of the deep fibular nerve, flexor digitorum longus tendon and/or flexor digitorium bevis muscle of a user's foot. This increases comfort and reduces potential injury to the nerves in the foot of a user, particularly when the bicycling shoe is secured on the user's foot for a prolonged period.

The embodiment depicted in FIG. 24 also includes a closure system 603 composed of three straps: an arch strap 605, a mid-foot strap 602, and a toe box strap 601. The closure system 603 closes the throat 610 over the tongue 609, to secure a user's foot in the bicycling shoe 600. As depicted in FIG. 24, the offset throat angle 630 does not require moving the components of the closure system 603 to accommodate the offset throat angle 630. However, the skilled artisan will readily appreciate that the components of the closure system 603 could also be displaced towards the lateral side of the bicycling shoe 600 without departing from the inventive concept of the offset throat angle 630 and its effect on the comfort and reduction of pressure and injury to the foot of a user of the present invention. In the preferred embodiment of FIG. 24, the arch strap 605, mid-foot strap 602, and toe box strap 601 have a strap angle in excess of 90 degrees, similar to the components of the closure system 403 of FIG. 21. The preferred embodiment of FIG. 24 includes a closure system 603 including an arch strap 605, a mid-foot strap 602, and a toe box strap 601, similar to the components of the closure system 403 of FIG. 21, but a related embodiment of the invention is a bicycling shoe 600 having an offset throat angle 630 as depicted in FIG. 24 with a closure system similar to the closure system 503 depicted in FIG. 22 including an arch buckle 505 and two straps: a mid-foot strap 502, and a toe box strap 501, the arch buckle 505 including an arch strap 520 coupled with a release clip 521.

Figure 14:
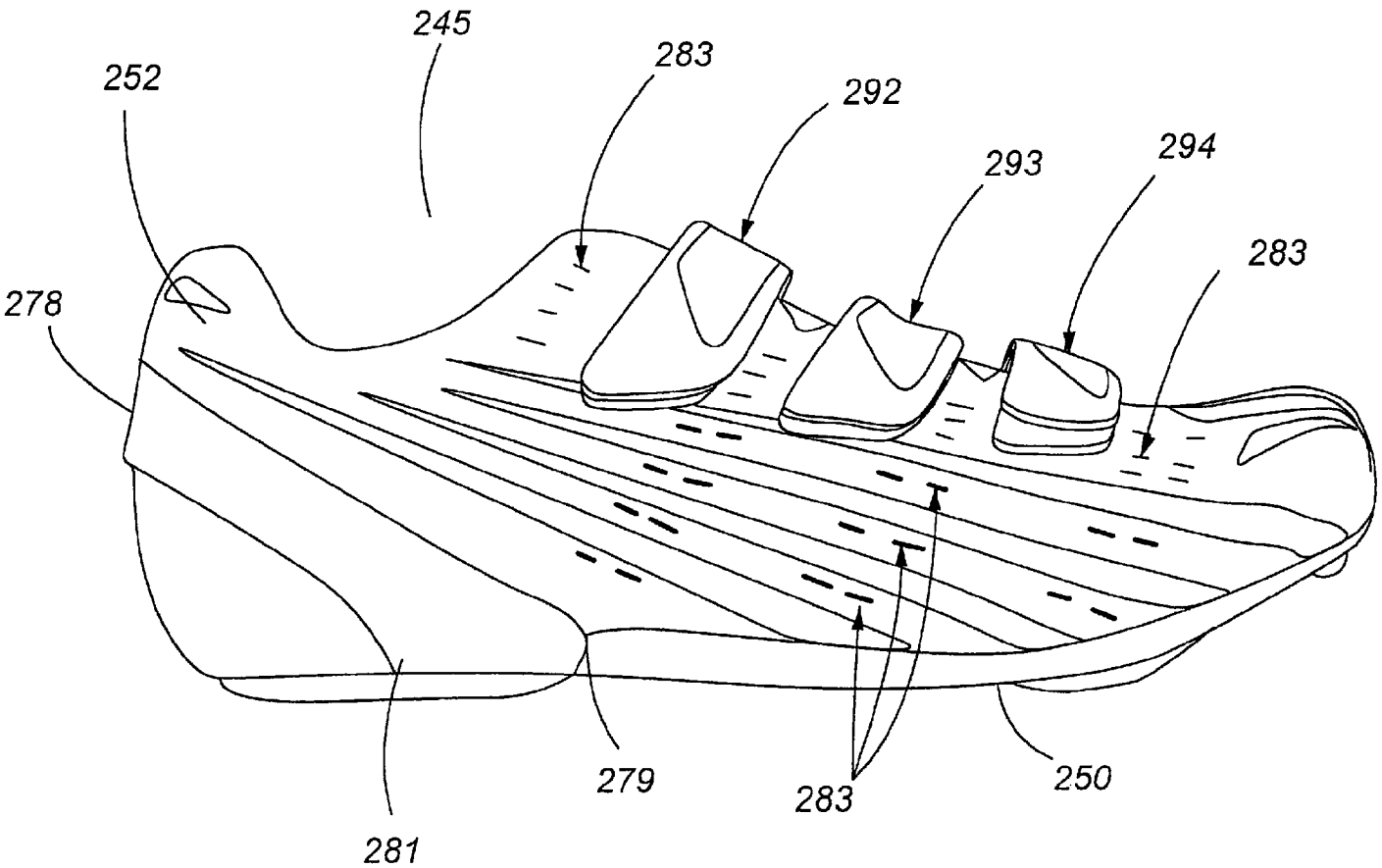
FIG. 14 depicts a side elevation view of another embodiment of the present invention.

In the embodiment depicted in FIG. 14, the upper 252 has a plurality of upper vent voids 283. Preferably, at least most, if not all, of the upper venting voids 283 are positioned at least about the tongue, toe box, vamp and quarter. More preferably, at least most, if not all, of the upper venting voids 283 are positioned about the tongue, vamp and quarter. Even more preferably, at least most of the upper venting voids 283 are positioned at least about the vamp.

The venting voids 283 transverse the upper 252, and preferably transverse the upper 252 and the liner. The plurality of venting voids 283 provide for fluid flow out of the interior cavity of the bicycling shoe.

Figure 7B:
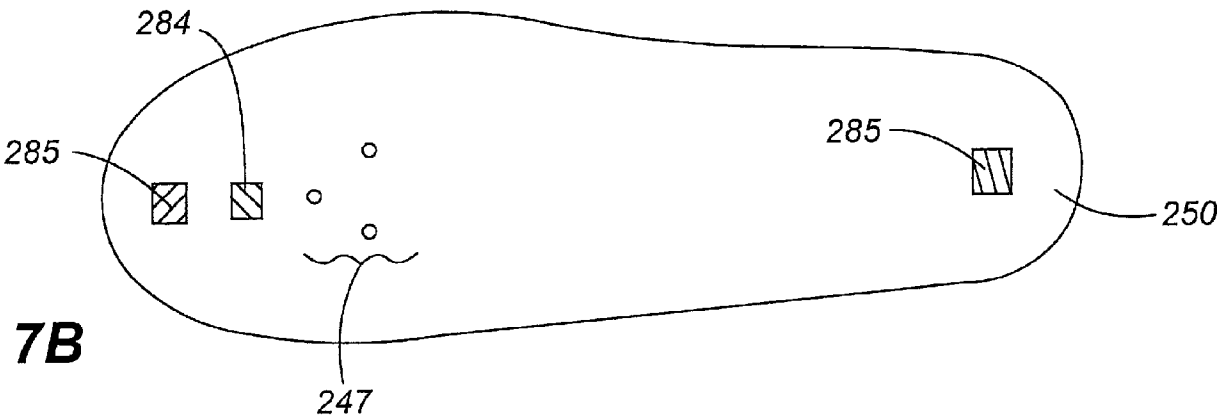
FIG. 7B depicts a bottom view of the embodiment of FIG. 7.

In an embodiment of the sole of a bicycling shoe shown in FIG. 7B, one or more sole venting voids 284 are situated in the sole 250. The sole venting voids 284 extend through the sole 250 into the interior cavity and provide for fluid flow out of the interior cavity.

The embodiment of FIG. 7B depicts one or more gaiting assist 285. The gaiting assist 285 may be composed of a polymeric material, a polymeric mixture, polymeric alloy or combinations thereof. The gaiting assist 285 is preferably located at an anterior and a posterior portion of the sole 250. In one configuration, the gaiting assist 285 is attached to the sole 250. The gaiting assist 285 is preferably attached to the sole 285 by an adhesive bond, a weld, a fusion bond, an alloyed bond, or a combination thereof. In another configuration, the gaiting assist 285 is partially embedded in the sole 250. The bicycling shoes of the invention may be difficult to walk in due at least to the rigidity of the sole. A gaiting assist 285 comprising a substantially non-slip and/or cushioning material aids the user of the bicycling shoes to more easily walk when wearing the shoe.

The embodiment of the sole of a bicycling shoe depicted in FIG. 7B includes the cleat attachment element 247. Cleat attachment 247 may be any element suitable for attaching a standard bicycle cleat, such as a cleat manufactured by one of the following manufacturers: SHIMANO™, CAMPAGNOLO™, LOOK™, WELLGO™ PYRAMID™, TIME™, FORZA™, MAVIC™, BEBOP™, and CRANK BROTHERS™. Preferably, the cleat attachment element 247 is configured for attaching a cleat manufactured by Shimano. The cleat attachment element 247 is situated on the sole 250 corresponding to a position below the user's proximal phalax or superior metatarsal, when the user's foot is secured within the shoe.

In another aspect of the invention depicted in FIGS. 11-13 and FIGS. 15A-FIG. 15E, the bicycling shoe 245 includes a linear rack 300 having a plurality of teeth on a strap rack 310, a release clip 308, and an arch strap 301 having a strap support 306, a pawl 304 and a strap rack 310. The linear rack 300 and release clip 308 are, respectively attached to the upper medial and lateral sides by at least one of stitching, welding and or adhesive bonding. The release clip 308 includes a ratchet mechanism that adaptively engages the strap rack 310, and a release leveler 309 that disengages the strap rack 310 from the ratchet mechanism. The release leveler 309 simply and easily disengages the strap 310 by one of pushing and/or lifting of the release leveler 309. In a preferred embodiment, the release clip 308 is composed of a material selected from the group consisting of metallic materials and polymeric materials. Preferably, the release clip 308 comprises a polymeric material.

Figure 16B:
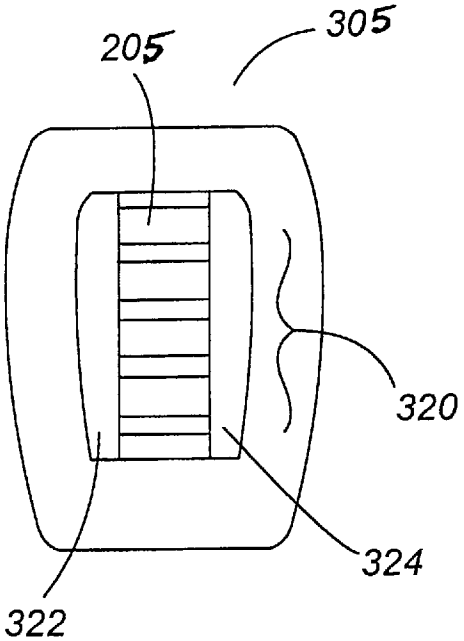
FIG. 16B depicts a top elevation view of another linear rack of the invention.
Figure 16A:
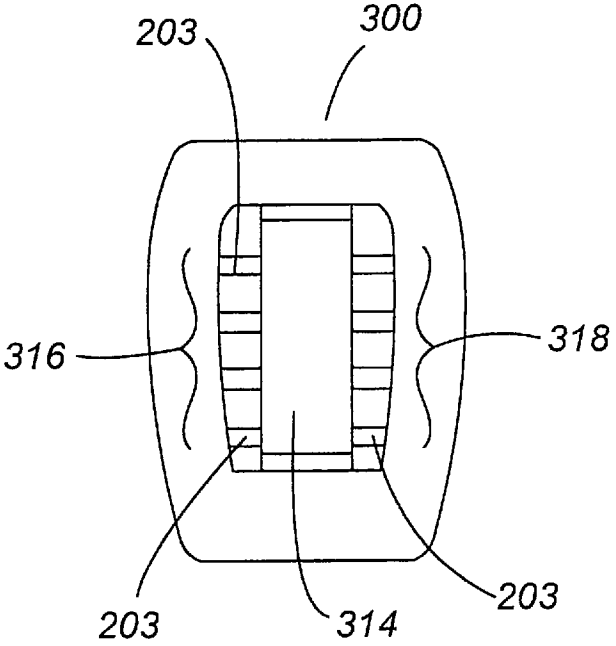
FIG. 16A depicts a top elevation view of a linear rack of the invention.

The linear rack 300 and plurality of teeth 203 are attached to the shoe 245 to adaptively engage the pawl 304. In one configuration, the pawl 304 comprises two cylindrical arms 312 extending from arch strap 301, while in another configuration, the pawl 304 comprises a single cylinder 313 suspended at one end of the arch strap 301. In the configuration depicted in FIG. 16A, when the pawl has two cylindrical arms, the linear rack 300 comprises a single rack void 314 positioned between first 316 and second 318 sets of the plurality of teeth 203. Similarly, in the instance of the pawl 304 having a single cylinder 313, the linear rack 305, as depicted in FIG. 16B, comprises a single set of the plurality of teeth 205 having on opposing sides first 322 and second 324 rack voids. In preferred embodiments, the plurality of teeth are curved and/or hooked to securely retain the pawl.

The pawl and linear rack, are preferably composed of one or more materials having a sufficiently large yield stress, such as metallic materials or polymeric materials. In a preferred configuration, the pawl contains a steel or stainless steel. In another embodiment, the linear rack contains a polymeric material.

Figures 15A, 15B, 15C, 15D, 15E:
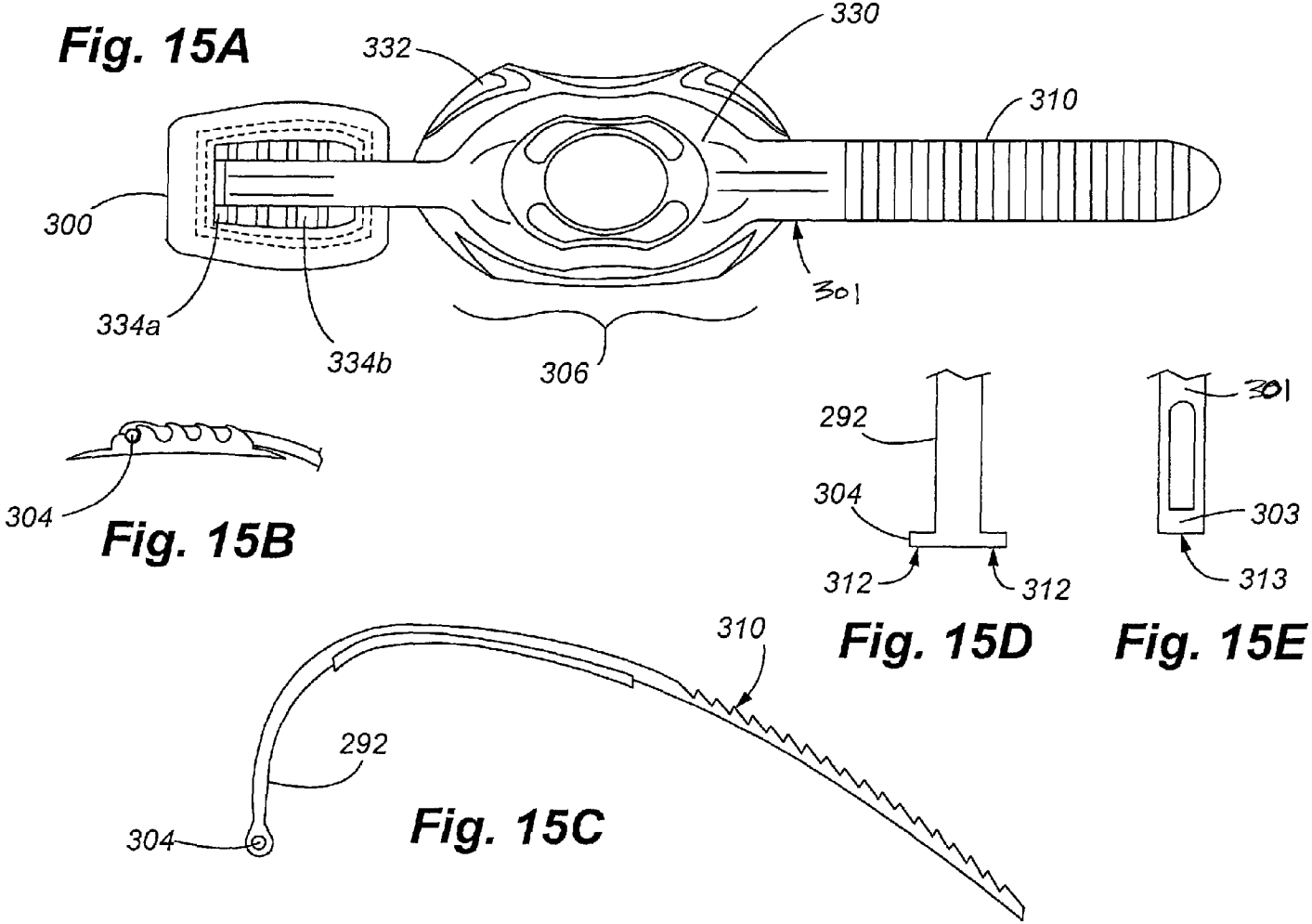
FIG. 15 (panels A-E) depict an embodiment of the linear rack, release clip, arch strap, strap support, pawl and strap rack of the present invention.

In the embodiment depicted in FIG. 15A, the strap support 306 extends out from the arch strap 301, and along a portion of the arch strap 301. In one configuration the strap support 306 is composed of one or more distinct elements and the distinct elements can differ in composition and shape.

The embodiment depicted in FIGS. 15A-15E depicts an embodiment of the strap support 306 having first 330 and second 332 strap support elements. The second strap support element 332 is located between the interior cavity of the bicycling shoe and the first strap element 330. Preferably, the first strap element 330 is continuous with and an integral element of the arch strap 292. The first strap element 330 and second strap element 332 may be composed of the same material or different materials. In a preferred embodiment, the second strap element 332 has at least one of: 1) a material having a hardness rating less than the first strap element 330; 2) a shape that reduces, compared to the first strap element 330, pressure exerted on the user's foot when the arch strap 301 is tightened about the user's foot; and 3) a combination thereof.

As depicted in FIGS. 15A and 15B, the pawl 304 can be adaptively engaged and disengaged from the linear rack. That is, the arch strap 301 can be connected and disconnected from the linear rack and therefore the bicycling shoe. The pawl 304 can adaptively engage the linear rack 300 at a plurality of engagement locations 334*a*-*b* on the linear rack 300, where engagement location 334*a* is further from the tongue of the bicycling shoe than engagement location 334*b*. From the plurality of engagement locations 334, the user may select a location that provides optimal comfort, positioning of the strap support 306 on the user's arch, and optimal tension across the user's foot. In one embodiment, engaging and disengaging the strap support 306 provides the user with an option to select an arch strap from a plurality of differing arch straps, each of which affords different materials and designs to provide variations in the desired comfort, support positioning location, tension, or design feature (such as, color, team affiliation, political or social message, or whimsical fun).

Figure 17:
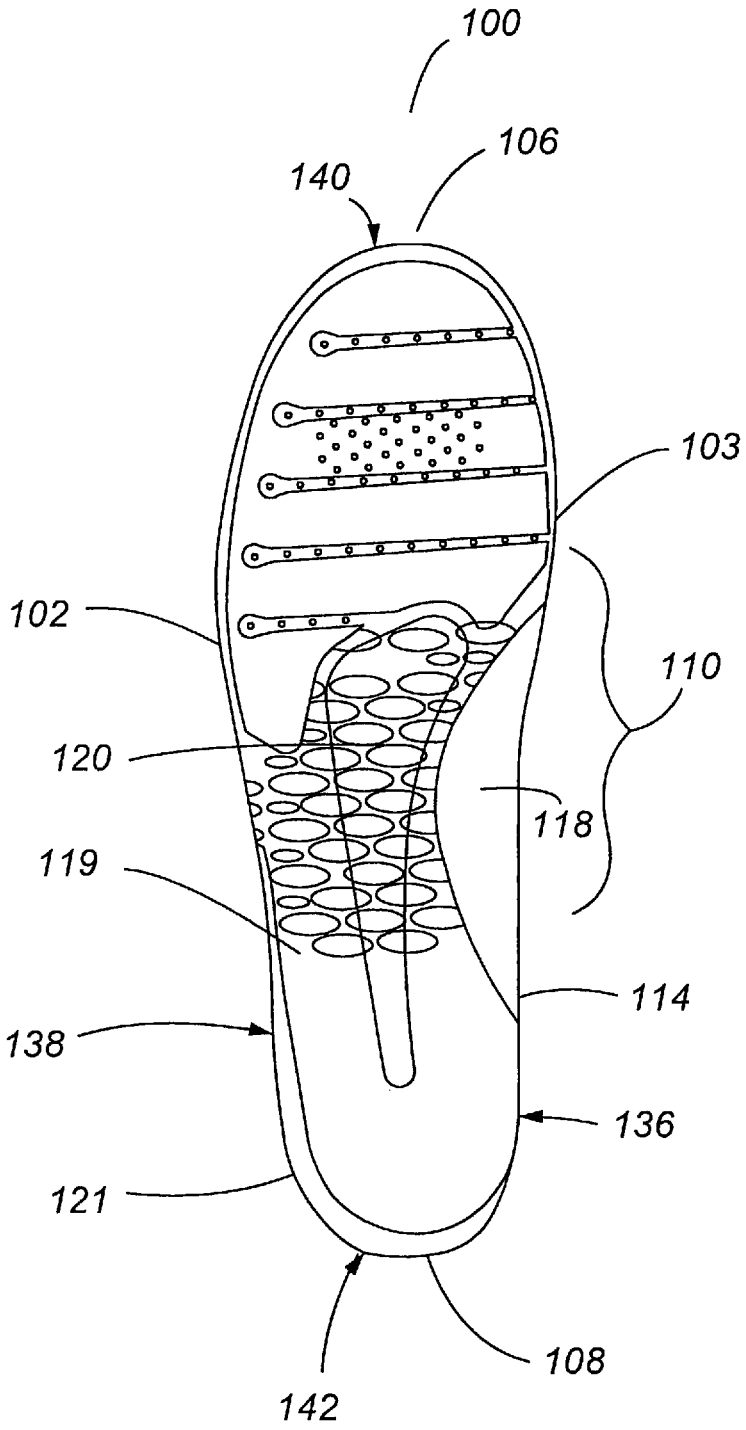
FIG. 17 depicts a top elevation view of one insole embodiment of the present invention.
Figure 18:
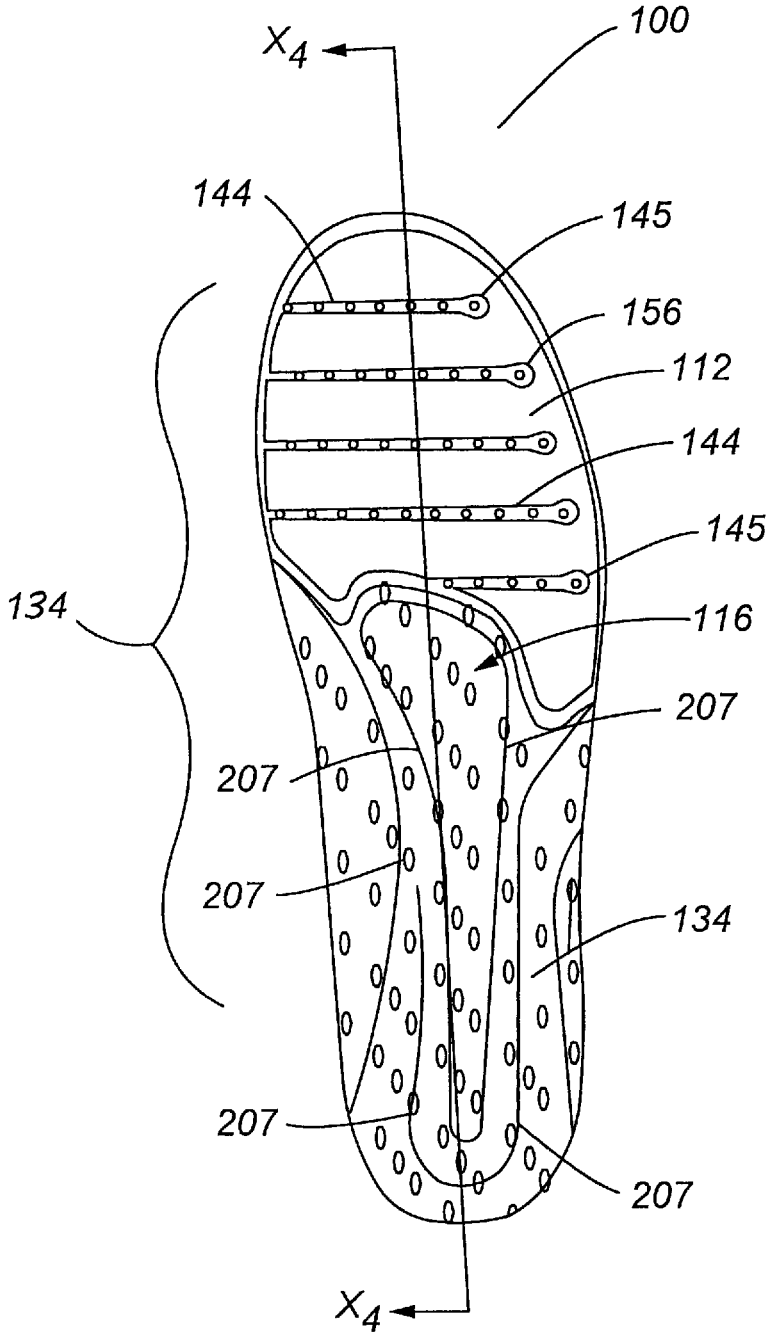
FIG. 18 depicts a bottom elevation view of one insole embodiment of the present invention.

Another aspect of the invention is an insole insert adapted to reside within the bicycling shoe, atop the sole of the shoe. FIGS. 17-18 depict various aspects of an insole insert 100 of the invention comprising opposing lateral 102 and medial 103 sides, opposing toe 106 and heel 108 ends, a mid-section 110 positioned between the toe 106 and heel 108 ends, opposing inner 114 and outer 116 surfaces, a varus wedge element 112 and an aft-support element 134. The toe 106 and heel 108 ends, respectively have toe 140 and heel 142 edges. Similarly, the lateral 102 and medial 103 sides, respectively have lateral 138 and medial 136 edges.

Figure 19B:
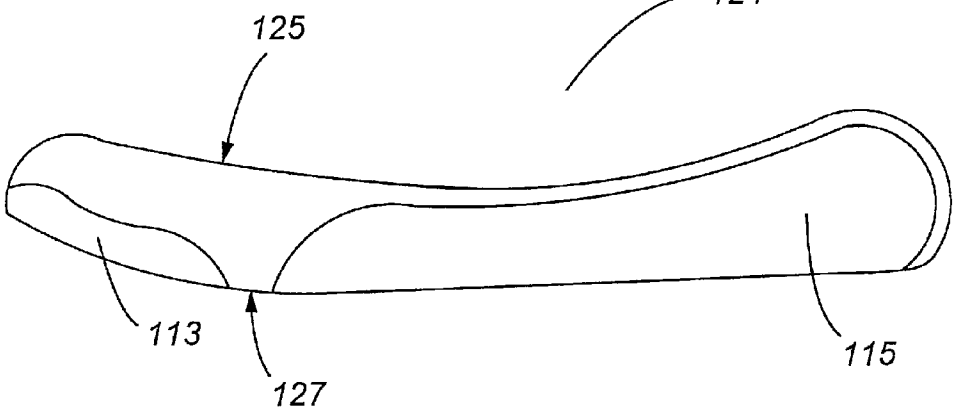
FIG. 19B depicts a side elevation view of one insole embodiment of the present invention.
Figure 19A:
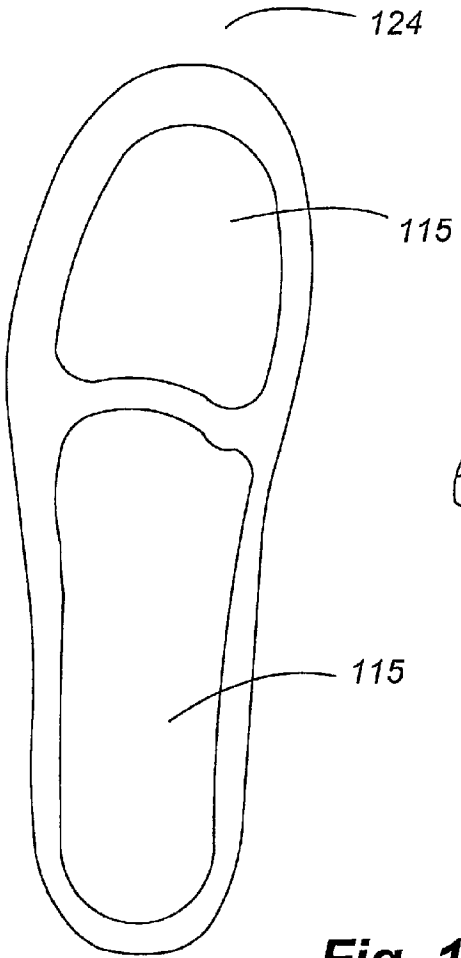
FIG. 19A depicts a bottom elevation view of one insole embodiment of the present invention.

In one embodiment, the insole 100 includes a bi-layer construction having first and second layers. As depicted in FIGS. 19A and 19B, the first layer 124 has opposing first layer top surface 125 and first layer bottom surface 127 and extends from the toe edge to the heel edge and from the medial edge to the lateral edge and may contain first 113 and second 115 voids.

The second layer 134, depicted in FIG. 18 includes a varus wedge element at region 112, and an aft-support element at region 134. The varus wedge element 112 and the aft-support elements 134, respectively, interconnect and mate with first 113 and second 115 voids to form a substantially smooth outer surface 116. The varus wedge element 112 is positioned adjacent to the aft-support element 134. In a preferred configuration, the varus wedge element 112 contacts the aft-support element 134.

Figure 23A:
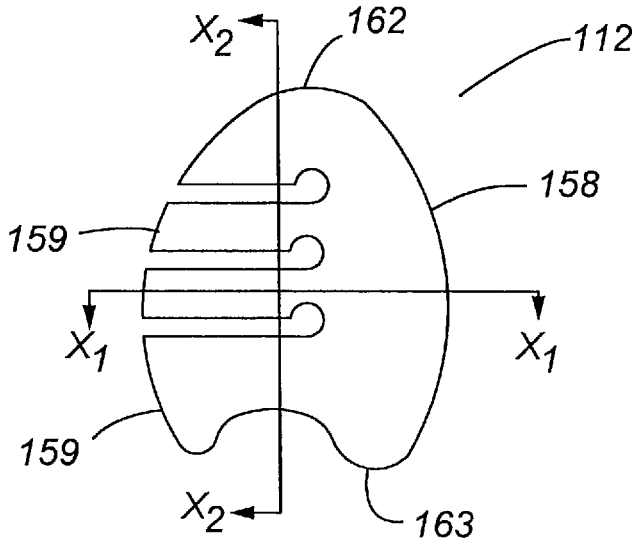
FIG. 23A depicts a bottom elevation view of a varus wedge element of the invention.
Figure 23B:
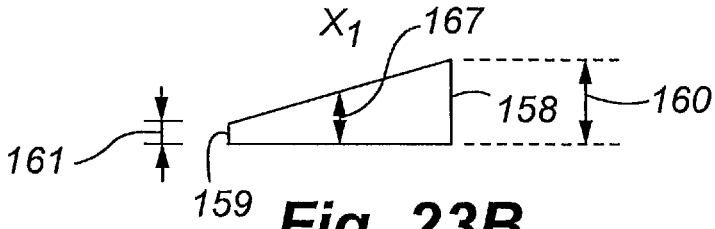
FIG. 23B depicts a cross-sectional view of a varus wedge element of the invention.
Figure 23C:
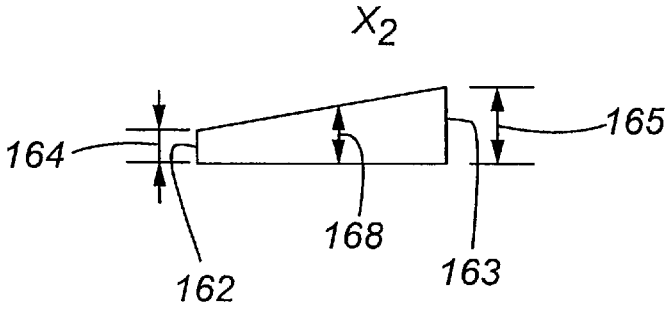
FIG. 23C depicts a cross-sectional view of a varus wedge element of the invention; and, FIG. 24 depicts a preferred embodiment of the bicycling shoe of the invention having an offset throat.

The varus wedge element 112 depicted in FIGS. 23A-23C includes opposing varus medial 158 and lateral 159 edges and opposing varus toe 162 and metatarsal 163 edges. The opposing varus medial 158 and lateral 159 edges, respectively have varus medial 160 and lateral 161 thicknesses. The varus medial 160 and lateral 161 thicknesses differ. In one embodiment, the varus medial thickness 160 is greater than varus lateral thickness 161. Preferably, the varus medial 160 and lateral 161 thicknesses differ from about 1 mm to about 5 mm, more preferably from about 1.2 mm to about 1.7 mm. The varus wedge 112 has a medial-lateral cross-sectional thickness 167. In a preferred embodiment, the cross-sectional thickness 167 uniformly transitions from the varus medial 160 to the varus lateral 161 thickness.

The varus medial thickness 160 ranges from about 0.5 mm to about 10 mm. In a preferred embodiment, the varus medial thickness 160 ranges from about 1.0 mm to about 8 mm, more preferably the medial thickness 160 ranges from about 4 to about 7 mm. The varus lateral thickness 161 ranges from about 0.1 mm to about 5 mm, preferably from about 0.5 mm to about 5 mm. More preferably, the varus lateral thickness 161 ranges from about 1 mm to about 3 mm.

The opposing toe 162 and metatarsal 163 edges have varus toe 164 and metatarsal 165 thicknesses, respectively. The varus toe 164 and metatarsal 165 thicknesses differ. In an embodiment, the varus toe thickness 164 is greater than varus metatarsal thickness 165, preferably, the difference between varus toe 164 and metatarsal 165 thicknesses differ from about 0.5 mm to about 8 mm and more preferably from about 1 mm to about 4 mm. The varus wedge 112 has a toe-metatarsal cross-sectional thickness 168. In a preferred embodiment, the toe-metatarsal cross-sectional thickness 168 uniformly transitions from the metatarsal thickness 165 to the toe thickness 164.

The varus toe thickness 164 ranges from about 0.1 mm to about 5 mm. In a preferred embodiment, the varus toe thickness 164 ranges from about 0.5 mm to about 5 mm, even more preferably, the toe thickness 164 ranges from about 1 mm to about 3 mm. The varus metatarsal thickness 165 ranges from about 0.5 mm to about 10 mm, preferably from about 1 mm to about 8 mm. More preferably, the varus metatarsal thickness 165 ranges from about 4 mm to about 8 mm.

Returning to the differing varus medial 160 and lateral 161 thicknesses, when a bicyclist applies a force to a bicycle pedal, the force is applied through the ball of the user's foot (commonly referred to as the user's forefoot). A forefoot varus refers to the ball of the foot being evaluated in relation to the lateral region of the foot, when the foot is in a non-weight bearing situation. In other words, in a non-weight bearing situation a varus forefoot has a big-toe up with respect to the lower leg. So when a cyclist applies pressure through the forefoot having a forefoot varus the user's tibia rotates turning the user's knee medially (in towards the bicycle). The medial rotation of the knee causes loss of the applied force (and power) and/or injury to the knee. Having the varus wedge element 112 located between the user's forefoot and the bicycle pedal aids in aligning one or both of the user's forefoot and knee when applying force to the pedal.

Stated another way, the user's forefoot is positioned at an angle relative to the pedal. For a forefoot having a varus angle, the contact of the user's forefoot with the pedal rotates the user's tibia and knee medially. Positioning a varus wedge element 112 between the user's forefoot and the pedal adjusts the angle to a neutral (that is, level) position such that the user's tibia and knee rotate little, if at all. This increases the force applied to the pedal and decreases the strain and medial rotation on the knee. In other words, the varus wedge element 112 reduces knee wobble while peddling.

The varus wedge element 112 is positioned within first void 113 to substantially align with toe 146 and metatarsal 148 regions of a user's foot 147, when the user's foot 147 is in contact with the insole insert 100. In one embodiment, the varus edge 163 is correspondingly in alignment with metatarsal 148 region of the user's foot 147 when the user's foot is positioned on the insole insert 100. In one configuration, the varus lateral edge 159 forms at least a portion of the insole lateral edge 138. Similarly the varus medial edge 158 forms at least a portion of the insole medial edge 136 and the varus toe edge 162 forms at least a portion of the insole toe edge 140. In another configuration, the varus lateral 159, medial 158 and toe 162 edge form little, if any, of the inside lateral 138, medial 158 and toe 140 edges of the insole insert 100.

In the embodiment depicted in FIG. 18, the varus wedge element 112 contains one or more transverse varus channels 144. In one configuration, one or more of the transverse varus channels 144 have a varus channel eyelet 145. The varus wedge element 112 that contains one or more varus channels 144 has a greater flexibility than a varus wedge element lacking a channel or plurality of channels. The varus channel eyelet 145 further enhances the flexibility of the varus wedge 112. In one configuration, the channel eyelet 145 has an eyelet curvature 156. The eyelet curvature 156 and/or varus channels 144 reduce, and/or eliminate, stress and stress-points within the varus wedge 112 during flexion stress or compression of the wedge 112.

Figure 20A:
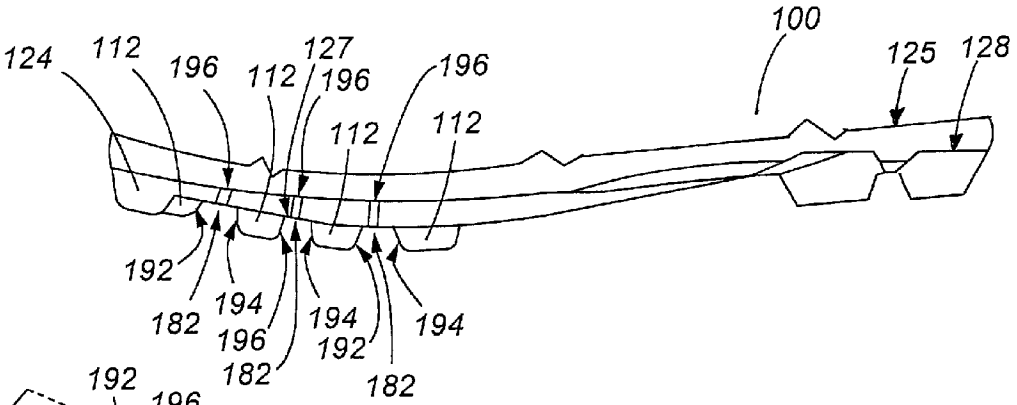
FIG. 20A depicts a side cross-sectional view of one outsole embodiment of the present invention.
Figure 20B:
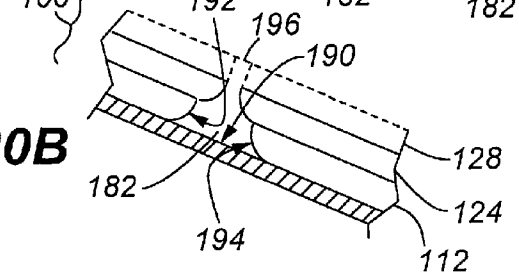
FIG. 20B depicts a side cross-sectional view of one portion of the outsole embodiment of FIG. 20A.
Figure 20C:
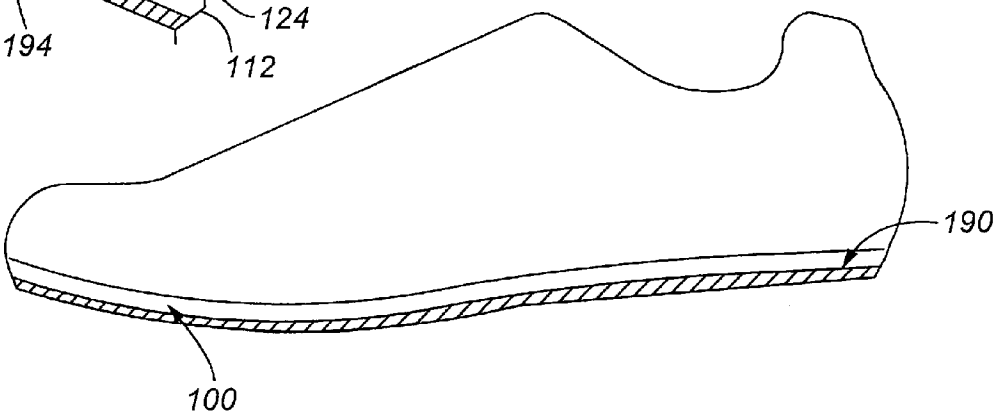
FIG. 20C depicts a side cross-sectional view of an embodiment of the present invention.

FIGS. 20A-20C depict a cross-sectional view of the insole insert 100 showing a plurality of varus comfort voids 182. The varus comfort void 182 comprises a void volume defined by opposing first 192 and second 194 varus channel walls, the first layer bottom surface 127 and a sole surface 190. The varus comfort void 182 interconnects with a vent void 196. The vent void 196 extends through the first layer 124 and an optional textile 128 adhered to the top surface 125. When applying pressure to the first layer 124 (such as when a cyclist applies a downward pressure on a pedal) the first layer 124 extends into one or more varus comfort voids 182. The extension of the first layer 124 into the one or more comfort voids 182 provides cushioning and/or flexion to the insole insert 100. The cushioning and flexion of the insole insert 100 provides a more even distribution of pressure at or near a pressure point on the user's foot during the application of the pressure. Furthermore, the user's foot experiences a massaging affect from the insole insert cushioning and flexion.

The vent voids 196 transmit fluid (such as a liquid and/or gaseous fluid) to provide further comfort to the user's foot. The cushioning and flexion of the insole insert 100 further facilitates fluid transmission through the vent voids 196. The transmission of fluid through the vent voids 196 removes at least some fluid away from the user's foot, thereby providing even more comfort to the user.

As depicted in FIG. 17, the insole insert 100 further comprises arch 118, transverse 120 and lateral 119 supports and a heel cup 121. The arch support 118 provides support to the medial arch 198 of foot 200, while the lateral support 119 provides support to the lateral arch 202 and lateral plantar aponeuriois 202 and calcaneometarasal ligament 203. The transverse support 120 provides support of planatar apotenuriois 204, digital slip of the plantar aponeurosist 205, and transvere faciculi 206 of the user's foot positioned on the insole insert 100. The support provided by the arch 118, lateral 119 and transverse 120 supports substantially reduce hot sports, pain and numbness in the user's foot 200. The heel cup 121 provides additional support and stability to the foot 200.

The heel cup 121 and arch 118, transverse 120 and lateral 119 supports are strengthened and stabilized by a plurality of insole grooves 207. The insole grooves 207 are positioned to provide at least some additional strength and/or stability to the supports 118, 119 and 120 and heel cup 121 beyond the strength and stability of first 124 and/or second 126 layers (that is, the strength and stability of the layers 124 and 126 alone and/or combined). Furthermore, the insole grooves 207 provide a degree of flexibility to the insole insert 100.

In these embodiments, the first layer, the aft-support element and the varus wedge elements preferably comprise a polymeric material, the polymeric material may included in the first layer, the aft-support element and the varus wedge element can be the same or can be different polymeric materials. The polymeric material for each of the first layer, the aft-support element and the varus wedge element may include homopolymers, copolymers, polymer mixtures and polymer alloys. The polymeric materials may also include a polymer such as polyolefins, polystyrenes, polyvinyls, polyacrylics, polyhaloolefins, polydienes, polyoxides/esthers/acetals, polysulfides, polyesters/thioesters, polyamides/thioamides, polyurethanes/thiourethanes, polyureas/thioureas, polyimides/thioimides, polyanhydrides/thianhydrides, polycarbonates/thiocarbonates, polyimines, polysiloxanes/silanes, polyphosphazenes, polyketones/thioketones, polysulfones/sulfoxides/sulfonates/sulfoamides, polyphylenes, and mixtures thereof.

In one embodiment, the varus wedge element contains polyurethane. The polyurethane has a hardness value from about 115 to about 65 on the shore A scale. In a preferred embodiment the hardness value for the polyurethane ranges from about 105 to about 70 on the shore A scale, more preferred from about 100 to about 75 on the shore A scale. Even more preferred, the hardness ranges from about 90 to about 80 on the shore A scale.

In another embodiment, the first layer and the aft-support element contain ethylene-vinyl acetate. The ethylene-vinyl acetate has a hardness value from about 60 to about 30 on the shore durometer scale. In preferred embodiment, the hardness value of the ethylene-vinyl acetate is from about 55 to about 40 on the Asker C scale, even more preferred from about 52 to about 44 on the Asker C scale.

In one configuration, the insole insert 100 is positioned between optional first and second textile layers. The first and second textile layers may contain natural and/or synthetic materials. These textile layers may include plant or animal fibers (such as, cotton or wool), rayons, polyesters, nylons, acrylics, aramids, polyamides, polyurethanes, polyolefins, polyactifes or mixtures thereof. The first and second textile layers may contain the same textile materials or differ.

In a preferred configuration, the first textile layer is positioned on and adhered to the first layer 124 of the insole insert 100. The first textile layer provides moisture control and/or comfort. The first textile layer is positioned adjacent to a user's foot and absorbs moisture generated by the user's foot. Furthermore, the first textile layer is more 'breathable' than the first layer. More breathable means that the first textile layer affords better air circulation than the first layer when positioned adjacent to the user's foot. Therefore, the first textile layer is perceived by the user to be cooler than the first layer. The first textile layer can contain one or more graphic images, alpha-numerical text and combinations thereof. The first textile layer can provide a non-slip surface and further cushion between the user's foot and the insole insert 100.

In one configuration, the second textile layer is positioned on and adhered to the outer layer 116. The second textile layer can provide a non-slip surface between the insole insert 100 and shoe insole 132. In another configuration, when the outer layer 116 provides a sufficient non-slip surface the second textile layer is omitted.

As used herein the term insole insert means both left and right forms of the insole insert 100. The insole insert may fit any of the standard international size designations for men or women. As for example, without limitation, the insole inset 100 has a size selected from the group consisting of the United States standard size designations of: 5, 5½, 6, 6½, 7, 7½, 8, 8½, 9, 9½, 10, 10½, 11, 11½, 12, 12½, 13, 13½, 14, 14½, 15, 15½, 16, 16½, 17, 17½, 18, 18½, 19, 19½, and 20 and a width selected from the group consisting of the United States standard widths of: AAA, AA, A, B, C, D, E, EE, EEE, EEEE, F and G.

Based on this disclosure and the accompanying drawings, one of skill in the art will readily understand that the aspects and embodiments described above are not mutually exclusive in any combination. Thus, each of the aspects and embodiments described above may be combined in any combination to make and use a bicycling shoe having improved comfort, fit, increased efficiency and reduced incidence of injury to the user. Thus, the liner positioned between at least a portion of the upper and tongue and the interior cavity of the shoe, and the insole composed primarily or entirely of a non-irritating liner material, and the sole that contains a unidirectional carbon fiber laminate, and the sole that contains venting voids in the sole, and the heel strap attached to the upper about the heel, and the lateral and medial quarter sides of the shoe, and the upper containing a plurality of vent voids that provide for fluid and air flow into and out of the interior cavity, and the closure system composed of a plurality of straps and a plurality of loops that have strap angles of greater than 90 degrees, and a gaiting assist located at least at anterior or posterior portions of the sole, and an arch buckle including an arch strap having a strap support, and an insole having varus wedge elements and/or arch supports and/or transverse and lateral supports and/or a heel cup, and an offset throat angle, may all be combined in a single, preferred, bicycling shoe or may be individually incorporated into a bicycling shoe, or may be combined in any combination to make and use a bicycling shoe of the invention.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. The features of the embodiments of the invention may be combined in alternate embodiments other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations, combinations, and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An athletic shoe comprising:

a sole, an upper attached to the sole to form a toe box, a vamp, a quarter, a throat and an interior cavity, a tongue attached to the upper proximate the toe box, and a closure system adapted to close the throat and secure the tongue on a foot of a user in a manner that reduces the pressure being applied to a user's medial branch of deep fibular nerve, flexor digitorum longus tendon and flexor digitorium bevis muscle, said closure system consisting of an arch connecting member and one of a toe box strap and a mid-foot strap, said arch connecting member having a fixed end attached to the lateral side of the upper and a loose end secured across the top of the upper, and secured on a medial side of said shoe, said one of said mid-foot strap and toe box strap having a fixed end attached to the lateral side of the upper and an opposing end secured by drawing one end of the one of said mid-foot strap and toe box strap across the top of the upper, and through one of a mid-foot strap loop and a toe box strap loop positioned and secured on a medial side of said shoe, and back over the upper, to connect with an opposing end of the one of said mid-foot strap and toe box strap, said arch connecting member being integrally attached to the medial side of the upper and affixed to said shoe at a point above the sole and medial of a heel-to-toe line, said arch connecting member being secured to said shoe at a fixed angle having an axis that extends essentially parallel with said medial edge of said shoe;

the one of said mid-foot strap loop and toe box strap loop being integrally attached to the medial side of the upper and affixed to said shoe at a point above the sole and medial of a heel-to-toe line, the one of said mid-foot strap loop and toe box strap loop being secured to said shoe at a fixed angle having an axis that extends non-parallel with said medial edge of said shoe and that intersects the toe of said shoe, said arch connecting member angle being different from the fixed angle of the one of said mid-foot strap loop and toe box strap loop;

wherein said arch connecting member is attached to the upper by at least one of stitching, welding, or adhesive bonding; and wherein the distance between the arch connecting member and the one of said mid-foot strap and toe box strap is greater than 0.5 inch and is adapted to distribute pressure generated by the closure system on one of the medial branch of the deep fibular nerve, flexor digitorum longus tendon and the flexor digitorium bevis muscle of a user's foot;

wherein, the closure system straps are secured by drawing one end of each strap across the top of the upper, through a loop, and back over the upper, to connect with an opposing end of the strap, and wherein said one of said mid-foot strap and toe box strap are positioned on the upper to intersect a toe-to-heel line at a strap angle between about 95 degrees and about 120 degrees.

2. The athletic shoe of claim 1, further comprising: a liner positioned between at least a portion of the upper and tongue and the interior cavity of the shoe.

3. The athletic shoe of claim 1, further comprising: a liner positioned between at least a portion of the upper and tongue and the interior cavity of the shoe, said liner having stitching in a location where a shear-force between the user's foot and the liner is minimal during use and where the stitching does not contact a user's.

4. The athletic shoe of claim 1, further comprising: a unidirectional carbon fiber laminate in the sole of the shoe.

5. The athletic shoe of claim 1, further comprising: venting voids in the sole of the shoe.

6. The athletic shoe of claim 1, further comprising: a heel strap attached to the upper about the heel, and lateral and medial quarter sides of the shoe.

7. The athletic shoe of claim 1, further comprising: a plurality of vent voids in the upper of the shoe.

8. The athletic shoe of claim 1, further comprising: a gaiting assist located on one of an anterior and posterior portion of the sole of the shoe.

9. The athletic shoe of claim 1, wherein said arch connecting member comprises an arch buckle comprising an arch strap having a strap support and a release clip that engages the arch strap.

10. The athletic shoe of claim 1, further comprising: an insole having at least one of varus wedge elements, arch supports, a transverse support, a lateral support and a heel cup.

11. The athletic shoe of claim 1, further comprising: an offset throat wherein the throat angles away from the medial side of the shoe and away from the heel-to-toe center line of the shoe, towards the lateral side of the upper.

* * * * *